US011229236B1

(12) United States Patent
Arnel et al.

(10) Patent No.: US 11,229,236 B1
(45) Date of Patent: Jan. 25, 2022

(54) WEARABLE VAPORIZATION SYSTEM

(71) Applicants: Scott M. Arnel, Oyster Bay, NY (US); Eric Schmiesing, Syosset, NY (US); Michael A. Willner, Lorton, VA (US)

(72) Inventors: Scott M. Arnel, Oyster Bay, NY (US); Eric Schmiesing, Syosset, NY (US); Michael A. Willner, Lorton, VA (US)

( * ) Notice: Subject to any disclaimer, the term of this patent is extended or adjusted under 35 U.S.C. 154(b) by 211 days.

(21) Appl. No.: 16/536,738

(22) Filed: Aug. 9, 2019

(51) Int. Cl.

| | |
|---|---|
| ***A24F 13/00*** | (2006.01) |
| ***A24F 40/40*** | (2020.01) |
| ***A44C 5/00*** | (2006.01) |
| ***A24F 7/00*** | (2006.01) |
| ***A24F 40/485*** | (2020.01) |

(52) U.S. Cl.
CPC ..... *A24F 40/40* (2020.01); *A24F 7/00* (2013.01); *A24F 40/485* (2020.01); *A44C 5/0007* (2013.01)

(58) Field of Classification Search
CPC ..... A24F 47/00
USPC ..... 131/328–329
See application file for complete search history.

(56) References Cited

U.S. PATENT DOCUMENTS

| | | | | |
|---|---|---|---|---|
| 4,236,239 | A * | 11/1980 | Imgruth | G04B 37/0083 368/276 |
| 6,779,917 | B1 * | 8/2004 | Chappuis | G04B 37/0083 368/282 |
| 7,462,035 | B2 * | 12/2008 | Lee | H01R 12/592 439/121 |
| 7,618,560 | B2 * | 11/2009 | Englebienne | B01J 13/0039 252/514 |
| D743,603 | S | 11/2015 | Inskeep | |
| D768,784 | S | 10/2016 | Kujawski et al. | |
| D783,305 | S | 4/2017 | Cain et al. | |
| D789,356 | S | 6/2017 | Cebe | |
| 9,716,337 | B2 * | 7/2017 | Keuten | H01R 12/62 |
| D799,746 | S | 10/2017 | Leidel et al. | |
| D825,102 | S | 8/2018 | Bowen et al. | |
| D827,117 | S | 8/2018 | Rigbi | |
| D833,064 | S | 11/2018 | Verleur et al. | |
| D833,921 | S | 11/2018 | Daigre | |
| D834,379 | S | 11/2018 | Truog et al. | |
| 10,835,693 | B2 * | 11/2020 | Klurfeld | A61M 11/00 |

(Continued)

FOREIGN PATENT DOCUMENTS

| | | | |
|---|---|---|---|
| CN | 304561784 | S | 3/2018 |
| CN | 207181974 | U | 4/2018 |

(Continued)

*Primary Examiner* — Phuong K Dinh
(74) *Attorney, Agent, or Firm* — Rosenberg, Klein & Lee

(57) ABSTRACT

A wearable vaporization system (100) is provided that includes a vaporization device (110) having a mouthpiece outlet portion (172) from which a vaporized composition mixed with air is withdrawn. The wearable vaporization system (100) further includes a vaporizer holder (130) that is releasably securable to a wrist of a user. The vaporizable holder (130) has a longitudinally extended cradle (132) and a receiving space (138) disposed thereon. One of the vaporization device (110) or the vaporizer holder includes a detent arrangement (121, 121*a*, 121*b*, 121*c*, 145) and the other of the vaporizer holder (130) or the vaporization device (110) includes at least one corresponding detent receiving recess (140*a*, 140*b*, or 142, 144 or 126, 128) for releasably retaining the vaporization device against lateral sliding displacement relative to the vaporizer holder (130).

21 Claims, 15 Drawing Sheets

(56) References Cited

U.S. PATENT DOCUMENTS

| | | | |
|---|---|---|---|
| 2016/0174607 | A1 | 6/2016 | Montgomery |
| 2017/0106152 | A1 | 4/2017 | Klurfeld |

FOREIGN PATENT DOCUMENTS

| | | | |
|---|---|---|---|
| CN | 207502934 | U | 6/2018 |
| CN | 207502935 | U | 6/2018 |
| CN | 208550030 | U | 3/2019 |

* cited by examiner

WEARABLE VAPORIZATION SYSTEM

BACKGROUND OF THE INVENTION

This disclosure directs itself to a wearable vaporization system that provides convenient storage and use of a vaporizable composition containing an inhalation ingredient, as an alternative to inhalation of smoke generated by burning a composition containing the desired inhalation ingredient. More in particular, the disclosure is directed to a wearable vaporization system that includes a vaporizer holder that is configured to be releasably secured to a wrist of a user and a vaporization device removably retained by the vaporizer holder to thereby be easily transported and used while being worn by the user. Still further, the disclosure is directed to a wearable vaporization system including a vaporization device removably retained by a vaporizer holder worn on a wrist of a user. The vaporization device is laterally displaceable and releasably retained in at least a pair of lateral positions relative to the vaporizer holder to improve a user's access to a mouthpiece of the vaporization device. The disclosure further directs itself to a vaporization device having a mouthpiece with an outlet portion extending angularly from the vaporization device housing to thereby be horizontally angled with respect to two adjacent end walls thereof. The mouthpiece has upper and/or lower upswept wall portions with an outlet opening being formed therebetween to make it easy for a user to make a good seal between the user's lips and the mouthpiece.

Electronic simulated smoking devices, commonly known as vaporizers, vapes, e-cigarettes or e-cigs, came into being in the early 1960's. These alternative devices to smoking have grown in acceptance and popularity because it is believed that they are less toxic to the user than the conventional smoking methods where a user inhales products of combustion, which products are known to include carcinogens. Without the toxic products of combustion being present, there is a greatly reduced concern about "secondhand smoke." The use of these alternative devices is also substantially odor free, making their use in public places more acceptable.

Nevertheless, there had not been a new or fashionable way of transporting or storing these devices on one's person until recently. Electrically operated vaporization devices designed to be worn on the wrist of a user, in place of a watch or combined with a timepiece, are known in the art. One such prior art device incorporates a retractable mouthpiece that must be released to extend out from the housing. The device is worn on one of the user's wrists and the spring biased mouthpiece must be released by the user's other hand, requiring the user to have both hands free. Subsequently, the user must push the mouthpiece back into its retracted position, again with the user's other hand. Another wrist worn prior art electrically operated vaporization device incorporates a watch function. This vaporizer watch has an output port, but no mouthpiece per say. Users, therefore, must try and obtain a seal between their lips and the housing of the device in the vicinity of the outlet port, which is not an easy task. These deficiencies in such prior art devices have created a need for a convenient, easy to use, wearable vaporization system.

SUMMARY OF THE INVENTION

A wearable vaporization system, is provided that includes a vaporization device having an upper face, a bottom face and a plurality of end walls on respective multiple sides of the vaporization device, each end wall extending between perimeter edges of the upper and bottom faces. The vaporization device further has a mouthpiece from which a vaporized composition mixed with air is withdrawn. The wearable vaporization system further includes a vaporizer holder configured to be releasably secured to a wrist of a user. The vaporizer holder includes a longitudinally extended cradle and a wrist securement strap extending from opposing longitudinal ends of the cradle. The cradle has a longitudinally extended base and a pair of elastic arm members respectively extending outwardly from opposing longitudinal ends of the base to define a receiving space therebetween. Each of the pair of arm members has a longitudinally directed flange formed at a distal end thereof facing the other of the pair of arm members. The vaporization device is removably retained within the receiving space and from which location a user can withdraw the vaporized composition mixed with air through said mouthpiece.

From another aspect, a wearable vaporization system is provided and includes a vaporizer holder configured to be releasably secured to a wrist of a user. The vaporizer holder includes a longitudinally extended cradle and a wrist securement strap extending from opposing longitudinal ends of the cradle. The cradle has a longitudinally extended base and a pair of elastic arm members respectively extending outwardly from opposing longitudinal ends of the base to define a first receiving space therebetween. Further, the wearable vaporization system includes a housing having an upper face, a bottom face and a second receiving space located between the upper and bottom faces adjacent one side of the housing. The housing has an opening formed between the upper and bottom faces and disposed in open communication with the second receiving space. The wearable vaporization system still further includes a cartridge configured for insertion into the second receiving space through the opening in the housing and releasable coupling with the housing thereat. The cartridge includes an electrically operated vaporizer and a contained space for storage of a composition to be vaporized by the electrically operated vaporizer. The cartridge has a mouthpiece disposed at one end thereof. The mouthpiece has an outlet portion extending angularly from a corner of the cartridge and has an outlet opening formed therein through which a vaporized composition mixed with air is withdrawn. The housing is removably retained within the first receiving space and from which location a user can withdraw the vaporized composition mixed with air through the outlet opening in the mouthpiece.

From yet another aspect, a wearable vaporization system is provided and includes a vaporization device having an upper face, a bottom face and a plurality of end walls on respective multiple sides of the vaporization device. Each end wall extending between perimeter edges of the upper and bottom faces. The vaporization device further has an electrically operated vaporizer and mouthpiece in open communication with an outlet of the electrically operated vaporizer and through which a vaporized composition is withdrawn. The mouthpiece is formed between two adjacent end walls of the plurality of end walls. The mouthpiece has an outlet portion horizontally angled with respect to both of the two adjacent end walls and has upper and lower wall portions with an outlet opening formed therebetween. At least one of said upper and lower wall portions of the outlet portion of the mouthpiece is angularly upswept. The wearable vaporization system further includes a vaporizer holder configured to be releasably secured to a wrist of a user. The vaporizer holder includes a longitudinally extended cradle and a wrist securement strap extending from opposing longitudinal ends of the cradle. The cradle has a longitudinally extended base and a pair of elastic arm members respectively extending outwardly from opposing longitudinal ends of the base to define a receiving space therebetween. The vaporization device is removably retained within the receiving space and from which location a user can withdraw the vaporized composition mixed with air through the mouthpiece. Each of the arm members has a laterally directed groove formed therein and disposed in a position for one of the arm members to respectively be in correspondence with the air inlet opening of the vaporization device to form an air flow passage irrespective of which lateral side of the vaporizer holder the vaporization device is inserted into the receiving space.

DETAILED DESCRIPTION OF THE PREFERRED EMBODIMENTS

Figure 1:
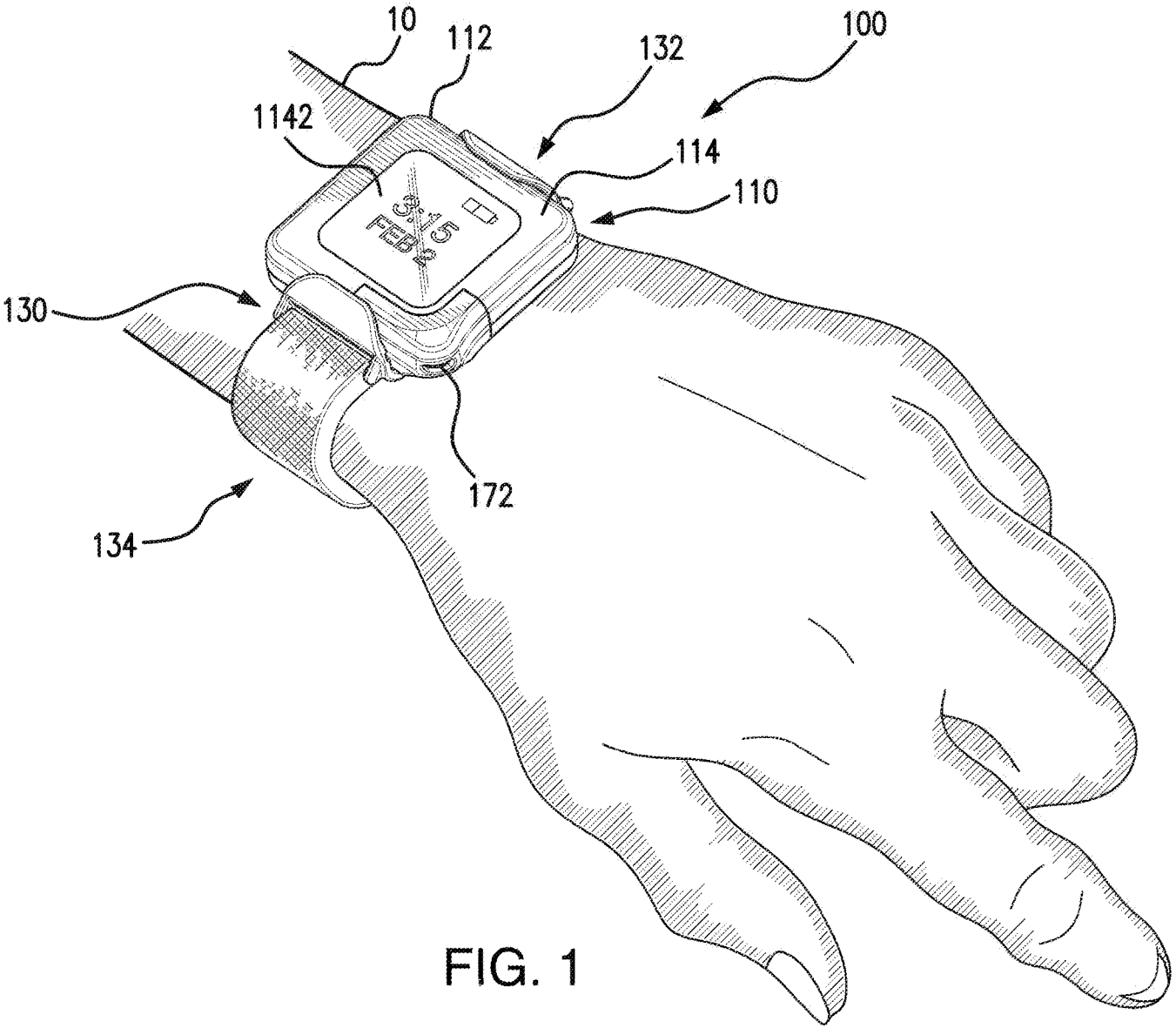
FIG. 1 is an illustration of the wearable vaporization system of the present invention being worn on a wrist of a user.

Referring to FIGS. 1-14, there is shown a wearable vaporization system 100 that includes a vaporizer holder 130 configured to be releasably secured to a user, for example, to the user's wrist 10. Wearable vaporization system 100 also includes a vaporization device 110 removably retained by the vaporizer holder 130 to thereby be easily transported and used while being worn by the user. As will be discussed in following paragraphs, vaporization device 110 may be releasably held in a selected one of multiple positions relative to the vaporizer holder 130 by an arrangement of detents 121, 121*a*, 121*b*, 121*c*, 145, to thereby locate the mouthpiece outlet portion or bit 172 of vaporization device 110 in an easily accessible position.

Figure 2:
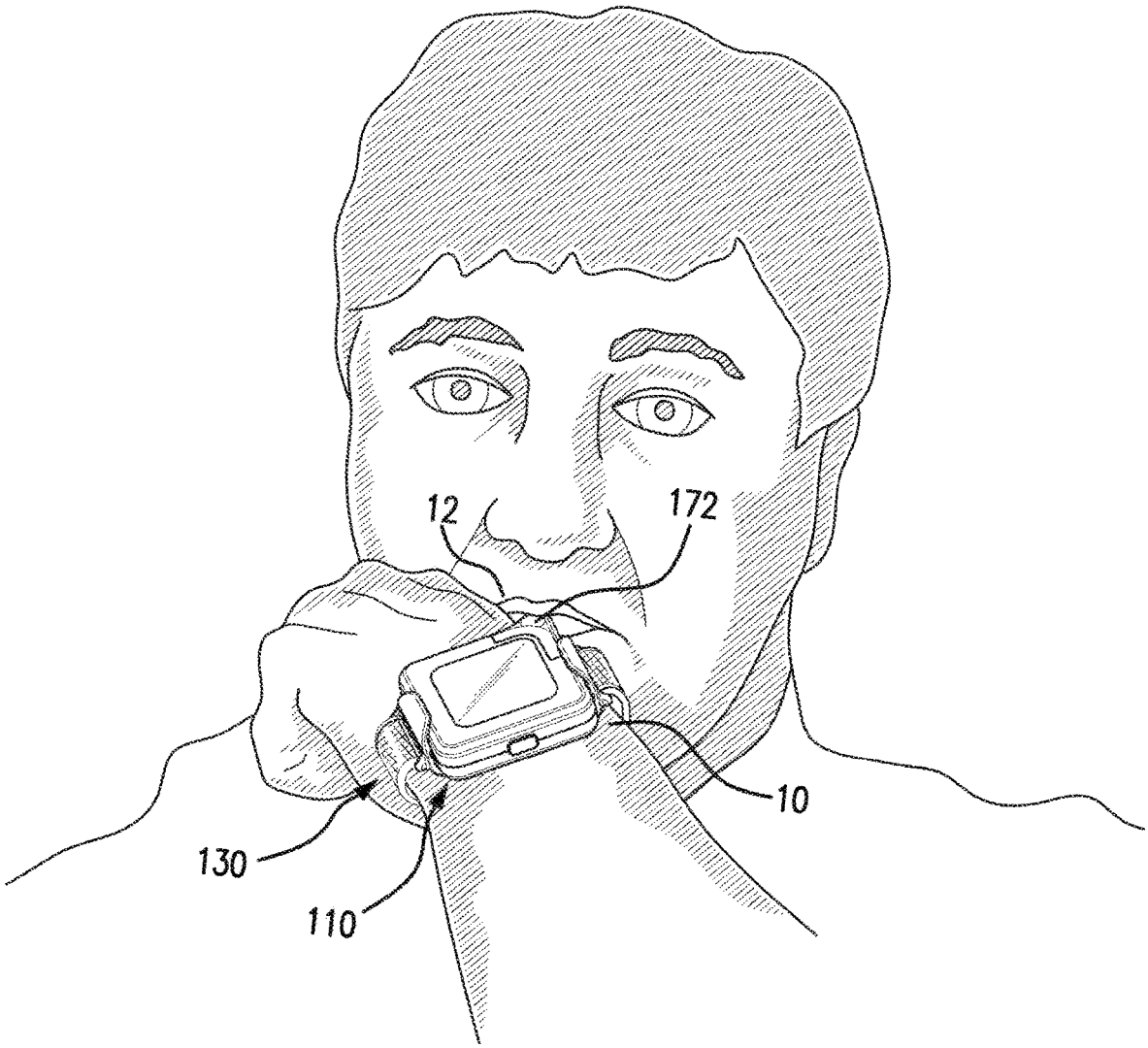
FIG. 2 is an illustration of the wearable vaporization system of the present invention being used while being worn on a wrist of a user.

Referring now to FIGS. 1 and 2, there is shown wearable vaporization system 100 releasably fastened to a user. In the particular exemplary embodiment illustrated, wearable vaporization system 100 is releasably fastened on the wrist 10 of a user. Wearable vaporization system 100 includes a vaporization device 110 from which a vaporized composition mixed with air is withdrawn through a mouthpiece outlet portion 172 responsive to the user's inhalation therethrough. Wearable vaporization system 100 further includes a vaporizer holder 130 having a wrist securement strap 134 for removably securing a cradle 132 to the user's wrist 10. Vaporization device 110 is worn by a user in the same manner as a wristwatch and the securement strap 134 may be in the form of any type of conventional watchband. Vaporization device 110 has a housing 112 with an upper face 114 that includes a display screen 1142. As will be described in following paragraphs, display screen 1142 provides status information to the user, such as battery state of charge, and may display time of day, as well, to provide the functionality of a wristwatch. In use, the user brings the vaporization device 110 to their mouth 12 so the user's lips can form a seal with the mouthpiece outlet portion 172 and draws a breath therethrough to initiate vaporization of a composition contained in the vaporization device 110. The vaporized composition is thereby inhaled by the user through the mouthpiece outlet portion 172.

Figure 3:
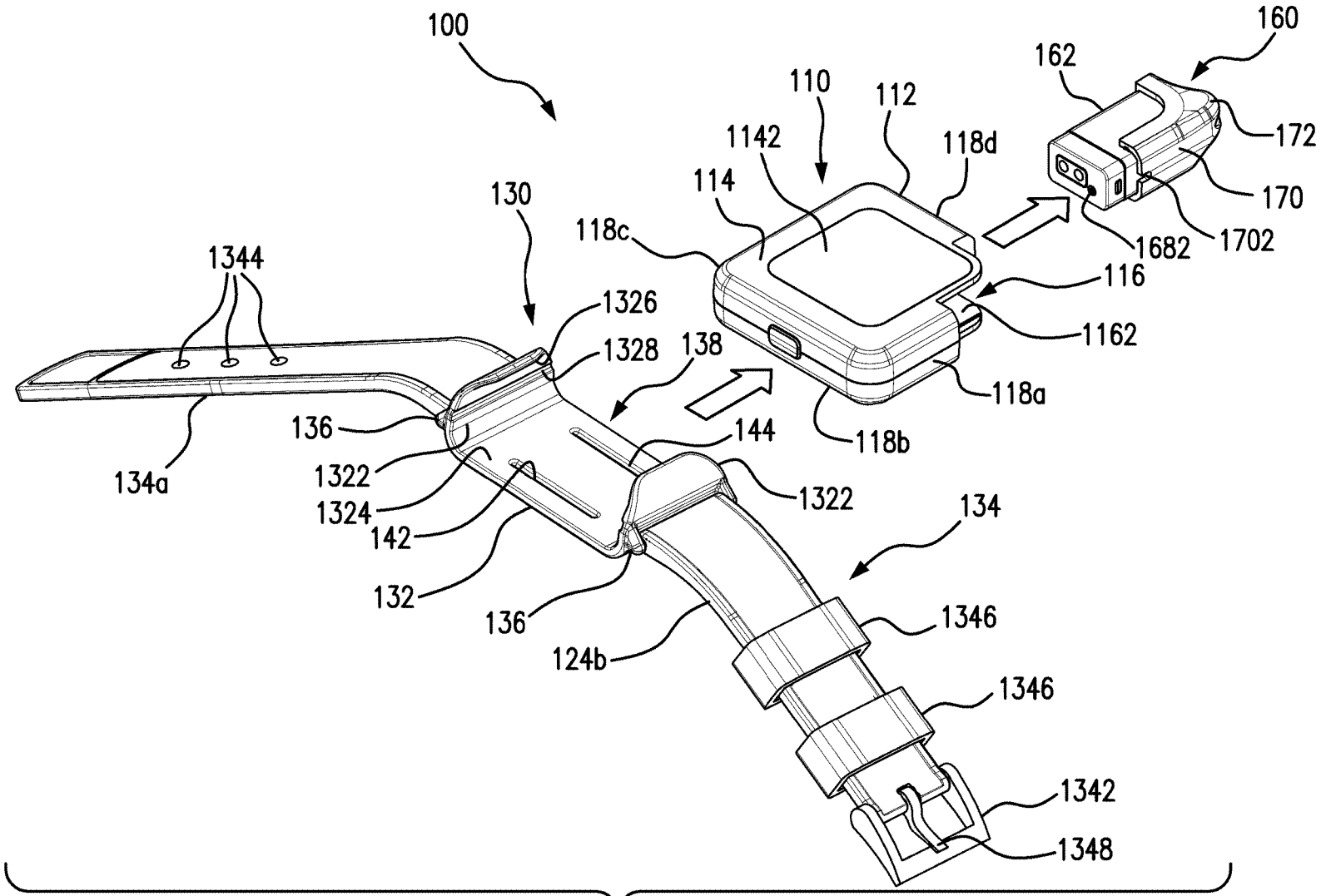
FIG. 3 is a schematic illustration of separable components of the wearable vaporization system of the present invention.

The vaporizable composition may be provided from a refillable container disposed within the housing 112. Alternately, for convenience and versatility, vaporization device 110 is provided with a replaceable vaporizer cartridge or "pod" 160 as shown in FIG. 3. Accordingly, vaporizer cartridge 160 is removably received within the cartridge receiving space 116 of the housing 112, and the housing 112 is removable and adjustably received within the receiving space 138 of the cradle 132 of vaporizer holder 130; all of which are included in wearable vaporization system 100.

Hence, wearable vaporization system 100 may alternately include the vaporizer holder 130, vaporization device 110 and the vaporizer cartridge 160.

Figure 5:
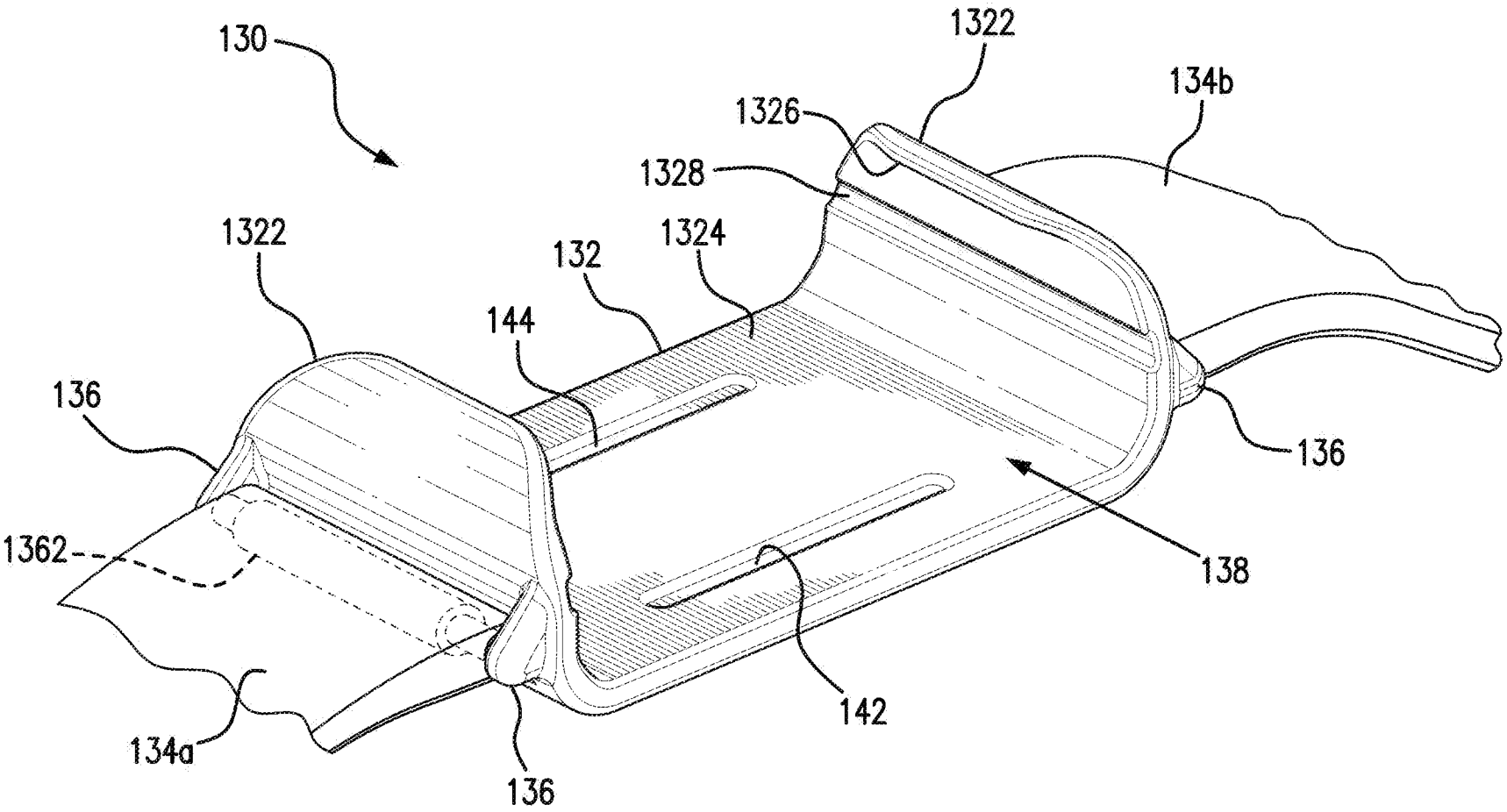
FIG. 5 is an enlarged view of the vaporizer holder of the present invention.

With reference to FIGS. 3 and 5, vaporizer holder 130 includes a cradle 132 formed by a longitudinally extended base 1324 and a pair of elastic arm members 1322, 1322 extending outwardly at opposing longitudinal ends of base 1324 to define a receiving space 138 therebetween into which the vaporization device 110 is received. The outer two longitudinal sides of the cradle 132 are each provided with a pair of transversely spaced lugs 136 for coupling to the wrist securement strap 134. Wrist securement strap 134 is coupled to the lugs 136 by conventional spring bars (watchband pins) 1362, like those used to secure a watchband to a watch case. Wrist securement strap 134 may be of the type that is a single expandable or clasp type strap coupled to the lugs 136 on opposing ends (not shown) or a two piece band having a first strap member 134*a* having a plurality of buckling holes 1344 and a second strap member 134*b* having a buckle 1342 with a buckle tongue 1348 to engage a selected buckling hole 1344 and at least one buckling loop 1346.

Figure 6:
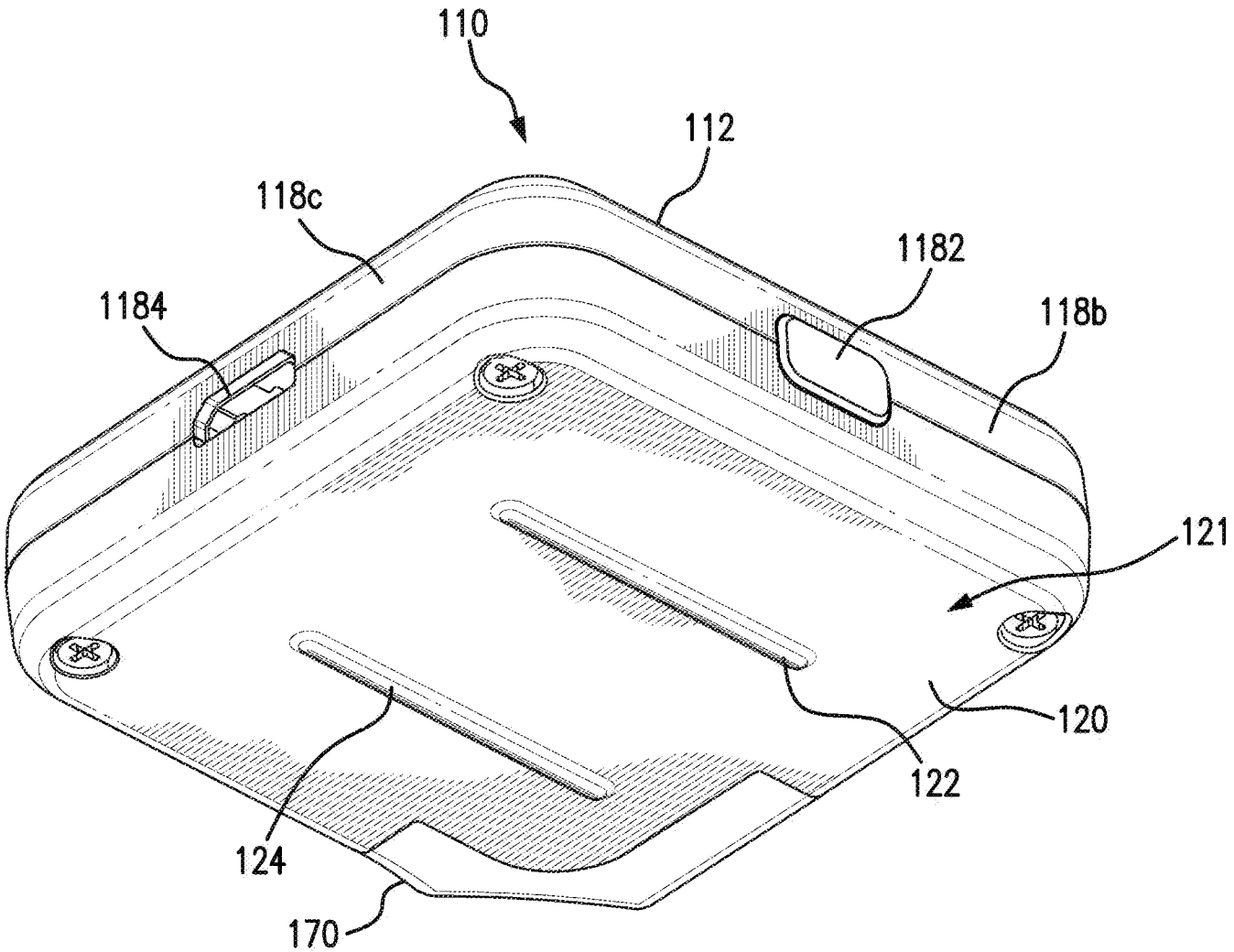
FIG. 6 is a bottom perspective view of the vaporization device of the present invention.

Each of the arm members 1322 has a flange 1326 extending inwardly (directed toward the receiving space 138), a lower surface of which frictionally engages a corresponding perimeter edge of the upper face 114 of vaporization device 110 when the vaporization device 110 is inserted into the receiving space 138. Each of the arm members 1322 also has a transversely directed groove formed thereacross, one of which serves as an air passage for air drawn into the vaporizer cartridge 160 when the user draws a breath through the mouthpiece outlet portion 172. To releasably limit sliding displacement of the vaporization device 110 transversely relative to the cradle 132, the base 1324 is provided with at least one recess 142 for receipt of a corresponding detent formed on a bottom face of the vaporization housing 112, an example of which is shown in FIG. 6. As will be described in following paragraphs, the detent arrangement 121 of wearable vaporization system 100 can vary in the number, location and configuration of the detent structures employed to releasably hold the vaporization device in position relative to the cradle 132.

Figure 4:
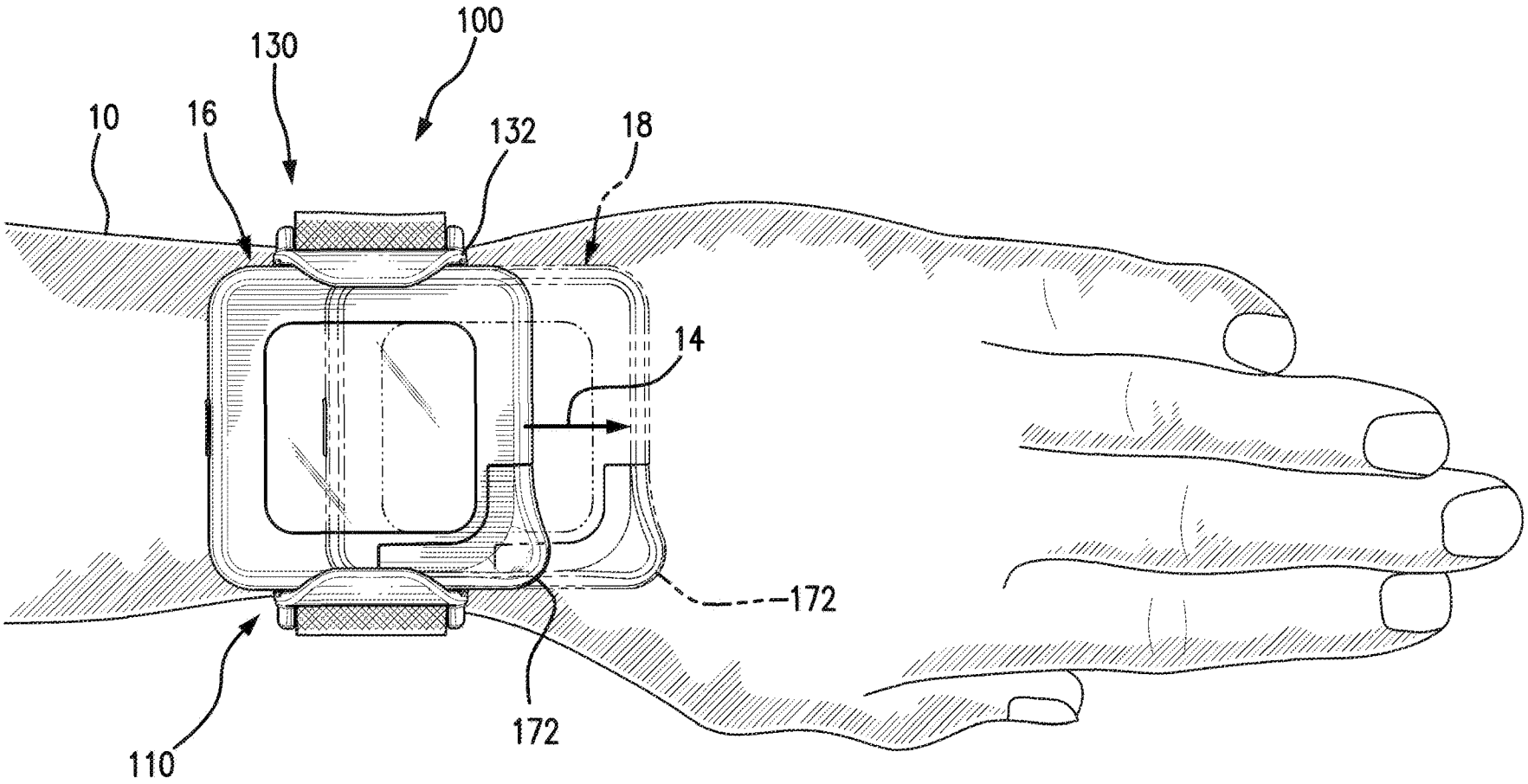
FIG. 4 is a schematic view showing the multiple use positioning of the vaporization device relative to the vaporizer holder of the present invention.
Figure 7:
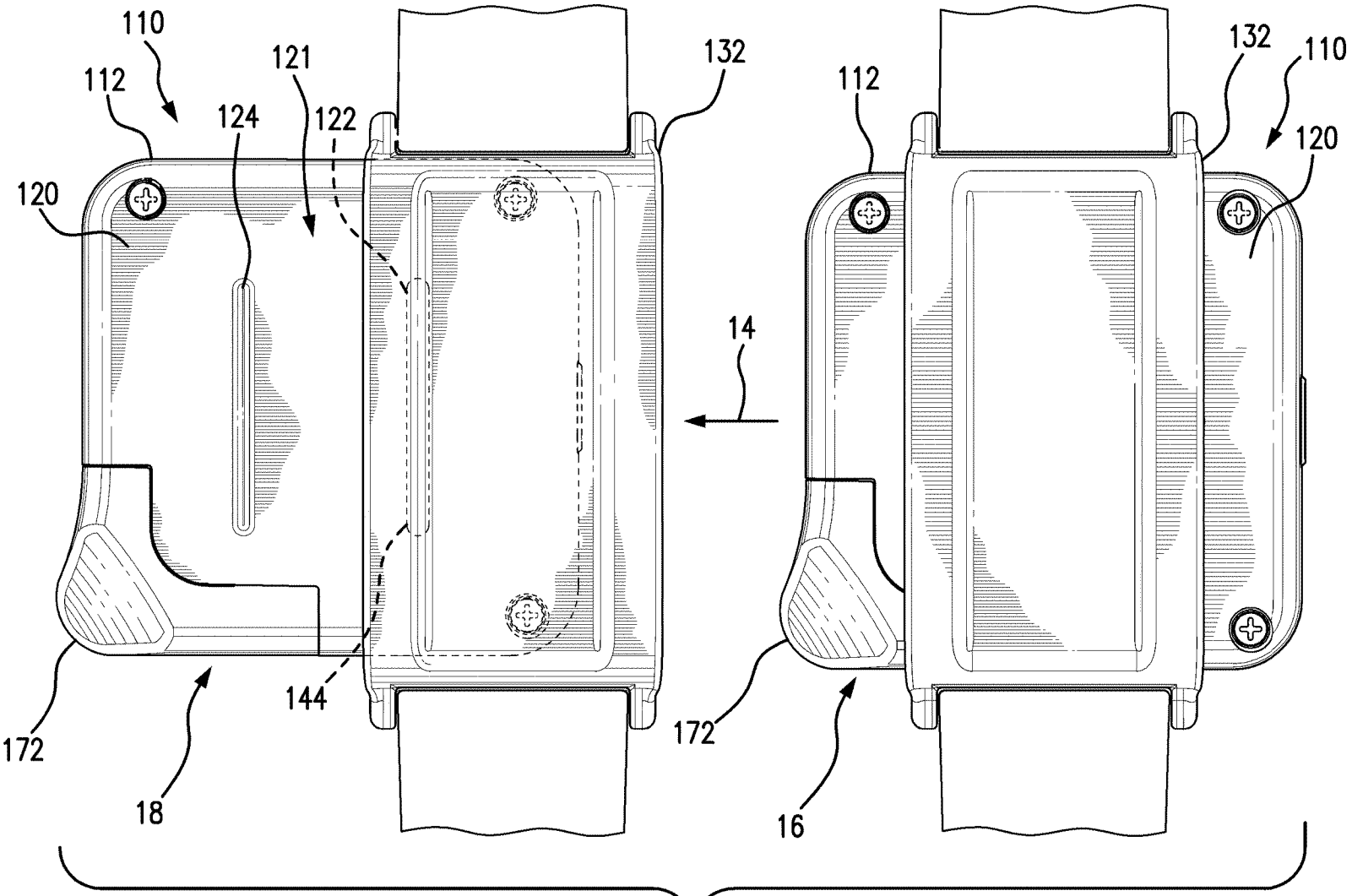
FIG. 7 is a schematic bottom view showing the multiple use positioning of the vaporization device relative to the vaporizer holder.

Although detent arrangement 121 with a single detent is all that is required to reliably hold the vaporization device 110 in position relative to the cradle 132, the provision of multiple transversely spaced detents provides a user with a choice of any of a plurality of positions and thereby position the vaporization device 110, and thereby the mouthpiece outlet portion 172 therewith, in an extended position, as illustrated in FIGS. 4 and 7. By this arrangement, mouthpiece outlet portion 172 is more accessible and thereby use of vaporizer system 100 is more convenient. Additionally referring to FIGS. 6 and 7, there is shown one configuration of detent arrangement 121 where in the bottom face 120 is formed with a pair of longitudinally extended protruding ribs 122 and 124 disposed in transversely spaced relationship and the base 1324 of cradle 132 is formed with a pair longitudinally extended grooves 142 and 144 disposed in transversely spaced relationship. When the vaporization device 110 is initially inserted into the receiving space 138 of the cradle 132, the detent ribs 122 and 124 are respectively placed into engagement with respective grooves 142 and 144 to releasably hold the vaporization device 110 against sliding displacement relative to the cradle 132 in a first position 16. In this first position 16, the vaporization device 110 is usable by the user, as illustrated in FIG. 2. However, if a user wishes more clearance between the mouthpiece outlet portion 172 and the cradle 132, the vaporization device 110 can be slidably displaced in the direction 14 to move the vaporization device 110 to the second position 18. Displacing the vaporization device 110 in the direction 14 disengages the detent ribs 122 and 124 from their respective engagement with grooves 142 and 144, followed by engagement of the detent rib 122 with the groove 144. In the second position 18, the detent rib 124 will be spaced away from the cradle 132 altogether.

Figure 7B:
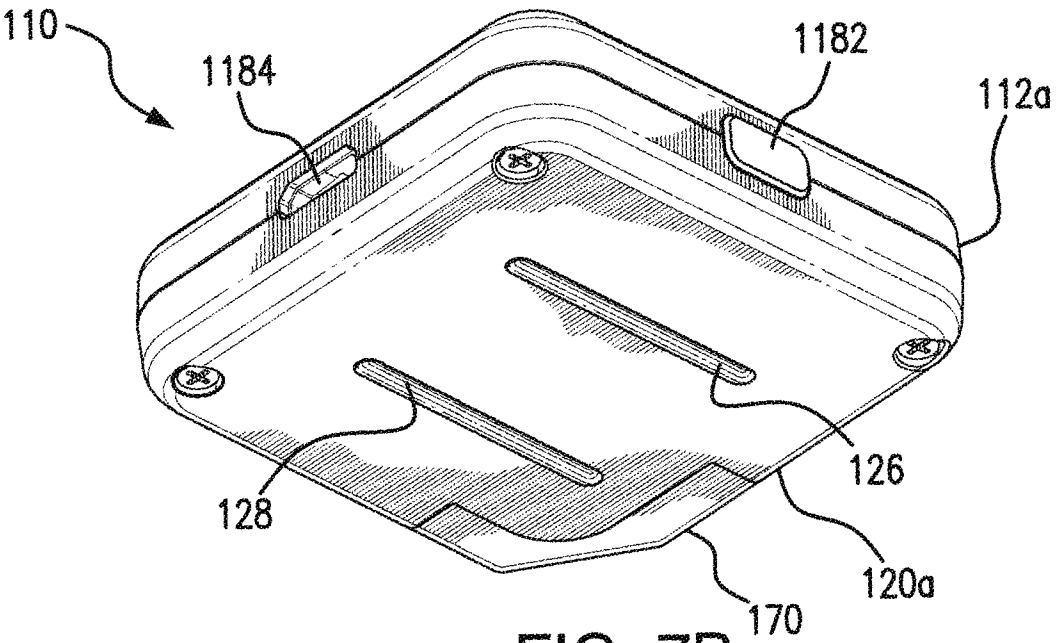
FIG. 7B is a bottom perspective view of the vaporization device showing detent receiving recesses formed therein.
Figure 7A:
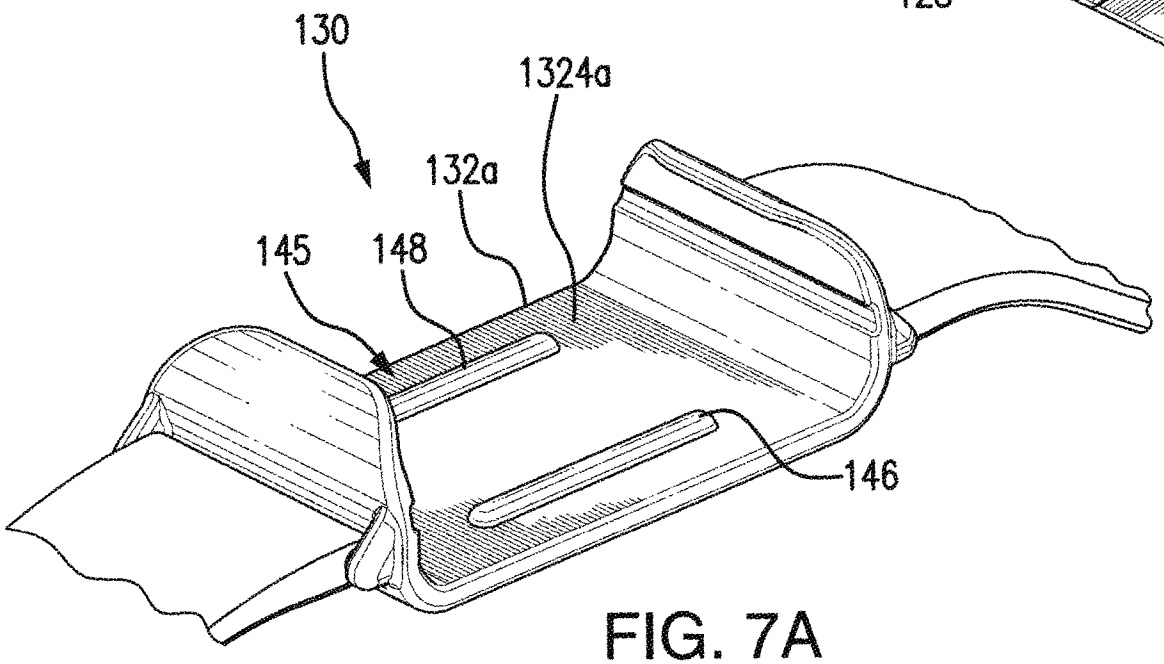
FIG. 7A is an enlarged view of the vaporizer holder of the present invention showing a detent configuration thereon.

As an alternate to the detent arrangement 121, protruding detent structures may be formed on the base of the cradle and complementary shaped recesses formed on the bottom face of the vaporization device housing. The detent arrangement 145, shown in FIGS. 7A and 7B, provides longitudinally extended detent ribs 146 and 148 which are formed on the base 1324*a* of the cradle 132*a* in transversely spaced relationship. The detent ribs 146 and 148 respectively engage grooves 126 and 128 formed in the bottom face 120*a* of the vaporization device housing 112*a*. This reciprocal arrangement of detents and detent receiving recesses operates identically to that which was described above to releasably hold the vaporization device 110 in each of the first and second positions 16 and 18. While two detent positions are being specifically described herein, it should be understood that a plurality of protruding detent structures, greater than two may be formed on one of the bottom face of the vaporization device housing or the base of the cradle and a corresponding plurality of complementary shaped recesses formed on one of the base of the cradle or the bottom face of the vaporization device housing to provide multiple discrete positions at which the vaporization device 110 can be releasably held relative to the cradle 132.

Figure 8C:
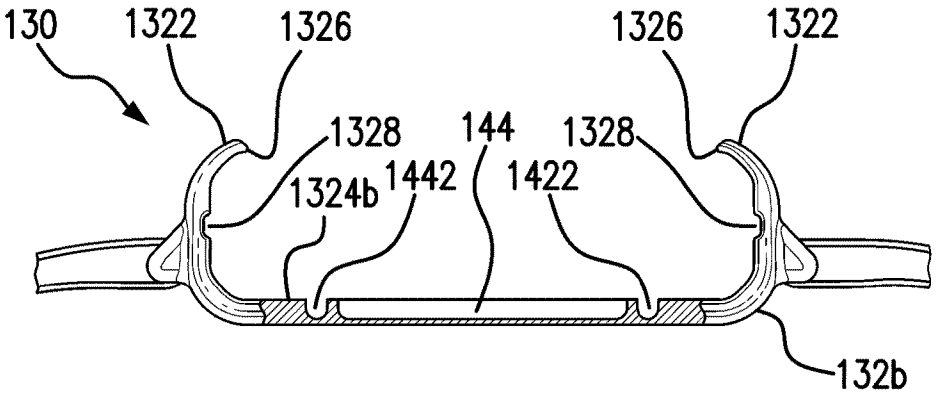
FIG. 8C is a cross-sectional view taken along the section line 8C-8C of FIG. 8B to further illustrate the detent receiving recesses.
Figure 8B:
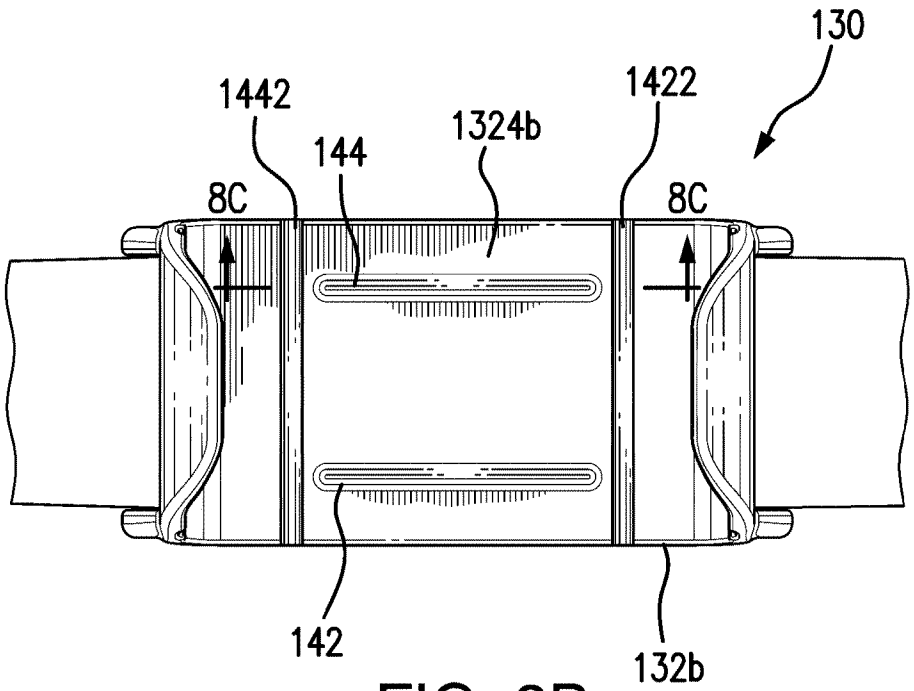
FIG. 8B is a plan view of the vaporizer holder showing an alternate configuration of detent receiving recesses corresponding to the detent configuration of FIG. 8A.
Figure 8A:
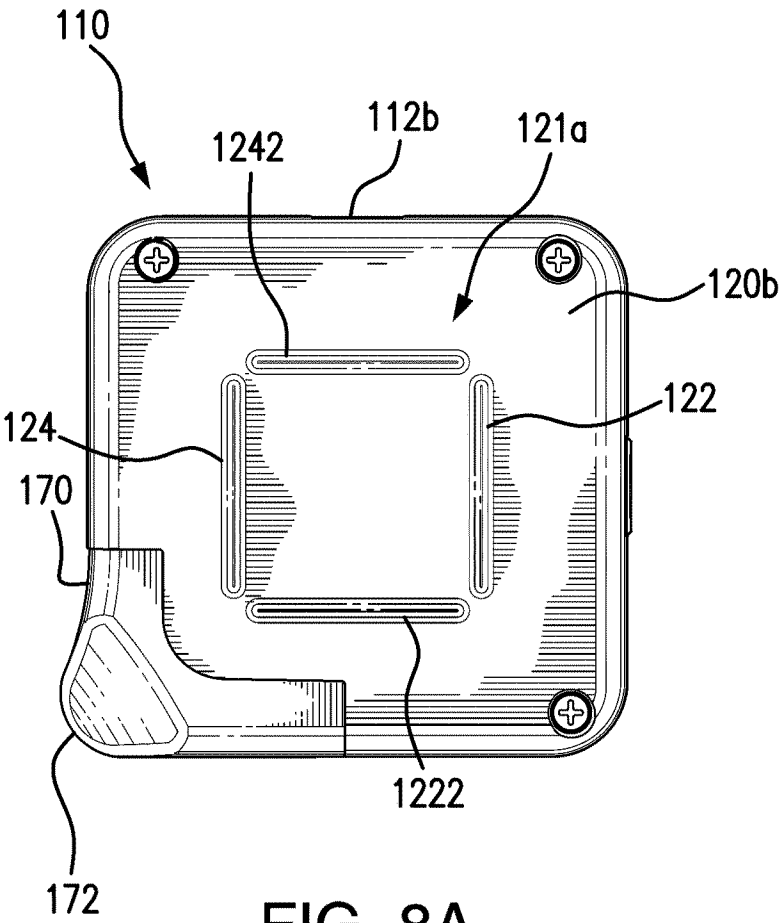
FIG. 8A is a plan view of the vaporization device showing an alternate configuration of detent ribs.
Figure 9C:
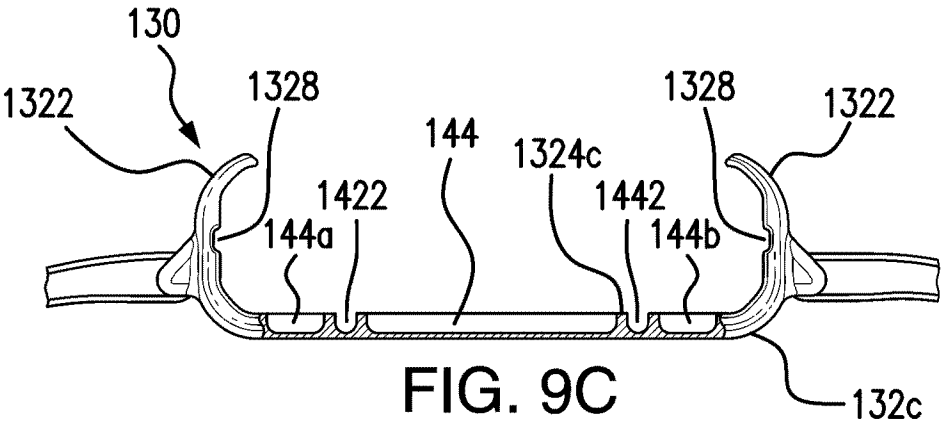
FIG. 9C is a cross-sectional view taken along the section line 9C-9C of FIG. 9B to further illustrate the detent receiving recesses.
Figure 9B:
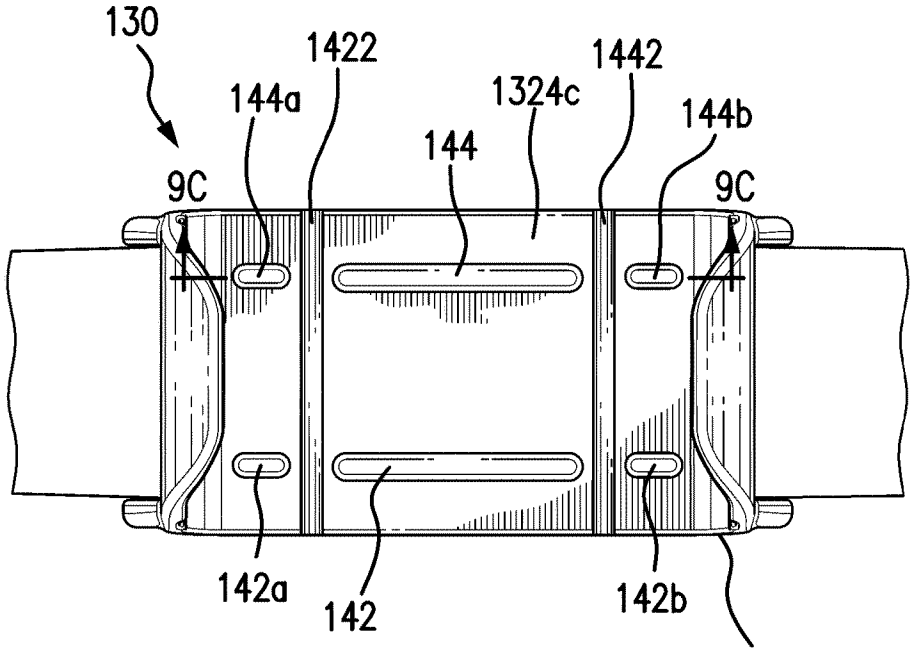
FIG. 9B is a plan view of the vaporizer holder showing a further configuration of detent receiving recesses corresponding to the detent configuration of FIG. 9A.
Figure 9A:
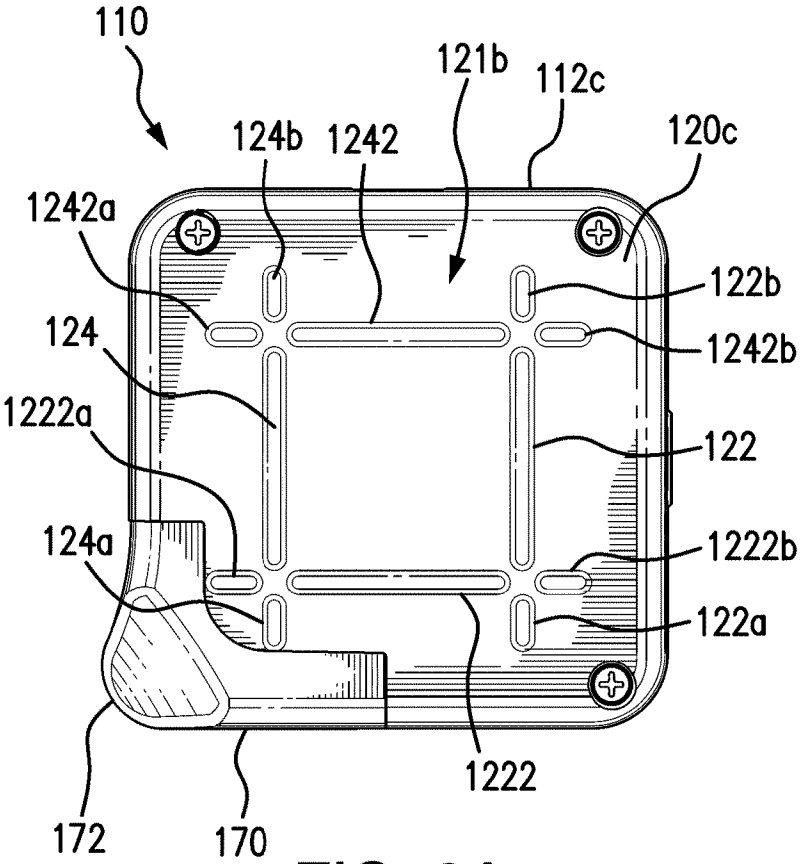
FIG. 9A is a plan view of the vaporization device with a further variation of the detent rib configuration of FIG. 8A.
Figure 10D:
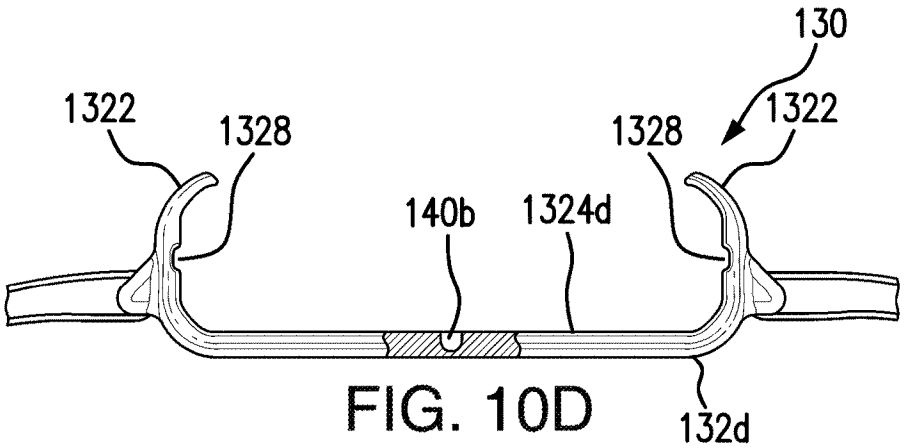
FIG. 10D is a cross-sectional view taken along the section line 10D-10D of FIG. 10C to further illustrate a detent receiving recess.
Figure 10C:
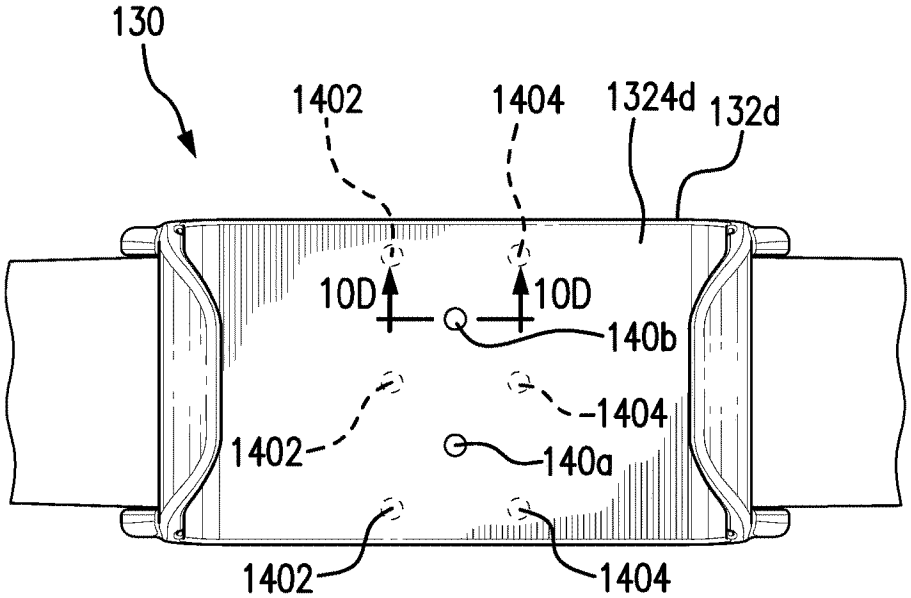
FIG. 10C is a plan view of the vaporizer holder showing alternate configurations of detent receiving recesses corresponding to the detent pin configurations of FIG. 10A.
Figure 10B:
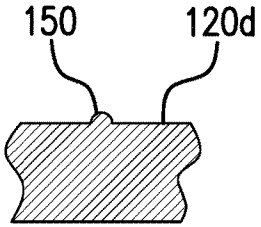
FIG. 10B is an enlarged cross-sectional view taken along the section line 10B-10B of FIG. 10A to further illustrate the detent
Figure 10A:
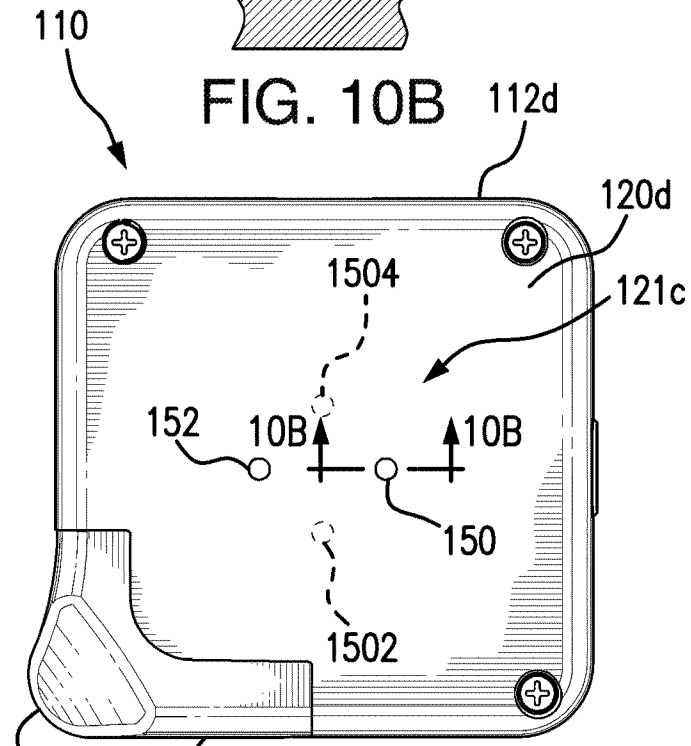
FIG. 10A is a plan view of the vaporization device showing alternate configurations of detent pins.
Figure 11B:
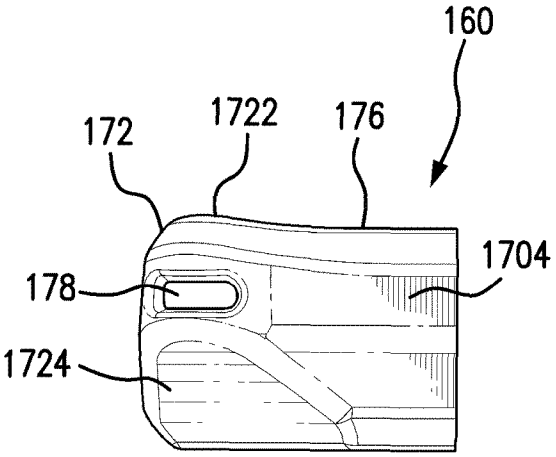
FIG. 11B is a front elevation view of the vaporizer cartridge of the present invention.
Figure 11C:
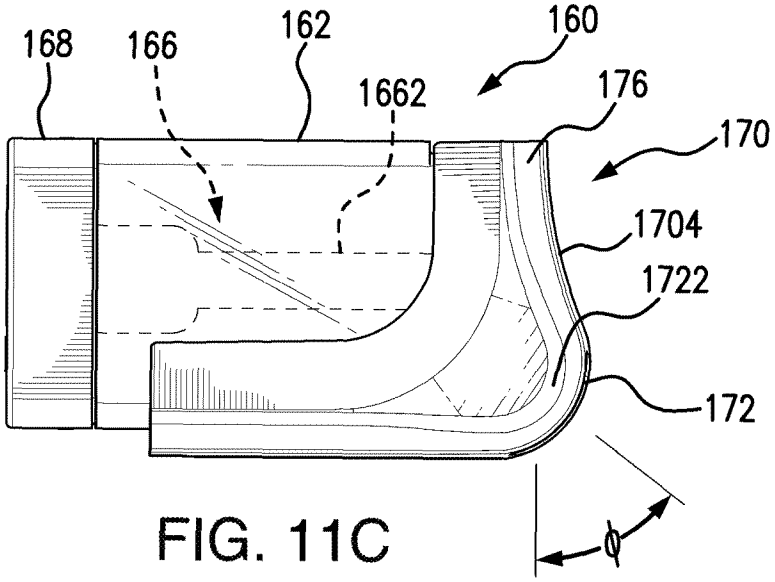
FIG. 11C is a top plan view of the vaporizer cartridge of the present invention.
Figure 11A:
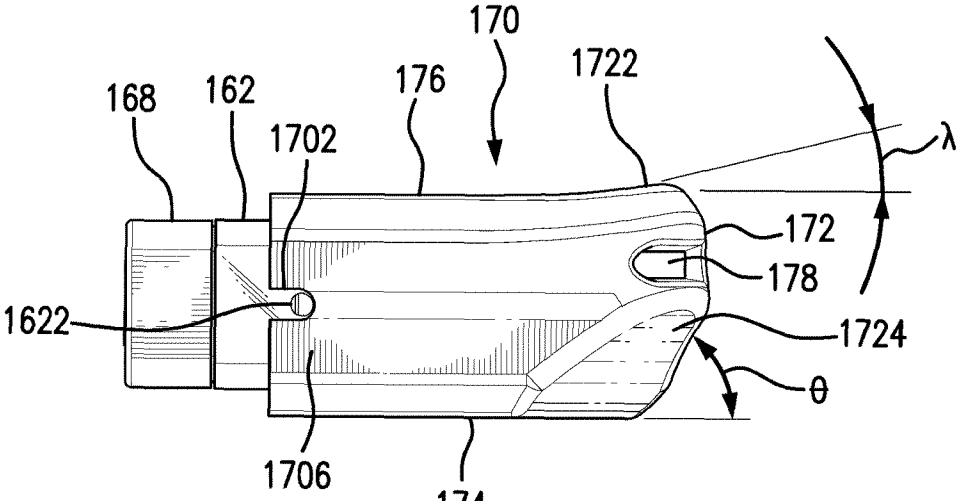
FIG. 11A is a side elevation view of the vaporizer cartridge of the present invention.

Additional protruding detent structures and complementary shaped recesses may also be provided so that the vaporization device 110 can be rotated 90° and inserted into the receiving space 138 to enable a user to wear and use the vaporization system 100 on their right wrist, which may be preferred by a left-handed user. One such arrangement for ambidextrous use of the vaporization device 110 is shown in FIGS. 8A, 8B and 8C, wherein the detent arrangement 121*a* includes both transversely spaced rib detents 122 and 124 and longitudinally spaced rib detents 1222 and 1242 formed on the bottom face 120*b*. The rib detents 1222 and 1242 are disposed orthogonally with respect to the rib detents 122 and 124. The base 1324*b* of the cradle 132*b* is formed with longitudinally extended detent receiving grooves 142 and 144 for being respectively engaged by one of the pairs of detent ribs 122 and 124, or 1222 and 1242, depending on the orientation of the vaporization device 112*b* relative to the cradle 132*b*. Thus, when the cradle 132*b* is worn on the user's left wrist, the detent ribs 122 and 124 engage the detent receiving grooves 142 and 144, while the rib detents 1222 and 1242 are slidingly disposed in the transversely extended grooves 1422 and 1442 that extend across the base 132*b*, from one side to the other. When the cradle 132*b* is worn on the user's right wrist, the detent ribs 1222 and 1242 engage the detent receiving grooves 142 and 144, while the rib detents 122 and 124 are slidingly disposed in the transversely extended grooves 1422 and 1442. In either scenario, which of the rib detents engages which of the grooves, on either wrist, will depend on the orientation of the cradle 132*b* relative to the user's hand, as the vaporizer holder 130 may be worn with either one of the detent receiving grooves 122 or 124 being closest to the user's hand. Another detent arrangement 121*b* that provides ambidextrous use of the vaporization system 100 is illustrated in FIGS. 9A, 9B and 9C. The detent arrangement 121*b* is similar to that of detent arrangement 121*a* discussed above, but includes added segments and corresponding added detent receiving recesses for increasing the resistance to displacement of the vaporizer device 110 relative to the vaporizer holder 130. The detent arrangement 121*b* includes both transversely spaced rib detents 122 and 124, and corresponding detent rib segments 122*a*, 122*b* and 124*a*, 124*b* and longitudinally spaced rib detents 1222 and 1242, and detent rib segments 1222*a*, 1222*b* and 1242*a*, 1242*b* formed on the bottom face 120*c*. The rib detents and detent segments 1222, 1222*a*, 1222*b* and 1242, 1242*a*, 1242*b* are disposed orthogonally with respect to the rib detents and detent segments 122, 122*a*, 122*b* and 124, 124*a*, 124*b*. The base 1324*c* of the cradle 132*c* is formed with longitudinally extended detent receiving grooves 142 and 144, and corresponding detent receiving groove segments 142*a*, 142*b* and 144*a*, 144*b* for being respectively engaged by one of the detent ribs and detent segments 122, 122*a*, 122*b* and 124, 124*a*, 124*b*, or 1222, 1222*a*, 1222*b* and 1242, 1242*a*, 1242*b*, depending on the orientation of the vaporization device 112*c* relative to the cradle 132*c*. The cradle 132*c* also has orthogonally directed transverse grooves 1422 and 1442. The groove 1422 extends between the longitudinal grooves 142*a* and 142 and between the longitudinal grooves 144*a* and 144. Similarly, the groove 1442 extends between the longitudinal grooves 142 and 142*b* and between the longitudinal grooves 144 and 144*b*. Thus, when the cradle 132*c* is worn on the user's left wrist, the detent ribs 122*a*, 122, 122*b* and 124*a*, 124, 124*b* engage the detent receiving grooves 142*a*, 142, 142*b* and 144*a*, 144, 144*b*, while the rib detents 1222*a*, 1222, 1222*b* and 1242*a*, 1242, 1242*b* are slidingly disposed in the transversely extended grooves 1422 and 1442 that extend across the base 132*c*, from one side to the other. When the cradle 132*c* is worn on the user's right wrist, the detent ribs 1222*a*, 1222, 1222*b* and 1242*a*, 1242, 1242*b* engage the detent receiving grooves 142*a*, 142, 142*b* and 144*a*, 144, 144*b*, while the rib detents 122*a*, 122, 122*b* and 124*a*, 124, 124*b* are slidingly disposed in the transversely extended grooves 1422 and 1442. Here again, in either scenario, which of the parallel rib detents and associated rib detent segments engages which of the parallel grooves and associated groove segments, on either wrist, will depend on the orientation of the cradle 132*c* relative to the user's hand, as the vaporizer holder 130 may be worn with either one of the detent receiving grooves and associated groove segments 122 and 122*a*, 122*b* or 124 and 124*a*, 124*b* being closest to the user's hand.

Another detent arrangement 121*c* is shown in FIGS. 10A, 10B, 10C and 10D. Detent arrangement 121*c* utilizes detents in the form of hemispherically shaped pins or protrusions 150 and 152 formed in the bottom face 120*d* of the vaporization device housing 112*d*. For ambidextrous use, the detent arrangement 121*c* of the vaporization device 110 formed on the bottom face 120*d* of vaporization device housing 112*d* further includes hemispherically shaped detents 1502 and 1504, spaced orthogonally with respect to the detents 150 and 152. The spaced detents 150 and 152 engage the transversely spaced openings 140*a* and 140*b* formed in the base 1324*d* of the cradle 132*d*, and define the first and second positions at which the vaporization device 110 is releasably held relative to the vaporizer holder 130. Thus, with respect to the detents 150 and 152 engaging one or both of the openings 140*a* and 140*b*, detent arrangement 121*c* functions like that of the detent arrangement 121, as illustrated in FIGS. 4-7, and the formation of the detents and openings may likewise be interchanged with the detents being formed in the base of the cradle and the detent receiving openings formed in the bottom face of the vaporization device housing, as is also true for the arrangement of detents for ambidextrous use.

As previously mentioned for ambidextrous use, the detent arrangement 121*c* includes one pair of aligned and spaced apart detents 150 and 152 and another pair of aligned and spaced apart detents 1502 and 1504, the aligned detents 1502 and 1504 being disposed orthogonally with respect to the detents 150 and 152. By that arrangement, either pair of detents 150 and 152 or 1502 and 1504 will engage the openings 140*a* and 140*b* when the vaporization device 110 is releasably held in the first position relative to the cradle 132*d*, depending on the orientation of the vaporization device 110 with respect to vaporizer holder 130 to accommodate left or right hand use. Likewise when the vaporization device 110 is in the second position relative to the cradle 132*d*, one of the detents 150 or 1504 will be engaged with one of the detent receiving openings 140*a* or 140*b*, depending on the orientation of the cradle 132*d* with respect to the user's hand. To accommodate the detents that will not be aligned with the openings 140*a* and 140*b*, the base 1324*d* may be firmed with transversely extending grooves 1422 and 1442, as shown in FIGS. 8B and 9B. However, to increase the releasable holding force of the detent arrangement 121*c*, the base 1324*d* of the cradle 132*d* may be formed with a series of aligned detent receiving openings 1402 and 1404. To accommodate placing the vaporization device 110 in two positions relative to the cradle 132*d* from either side of the cradle, each of the series aligned detent receiving openings includes three openings 1402, 1404. If a greater number of positions were desired, additional openings can be provided to accommodate the detents on the orthogonal axis.

Figure 12B:
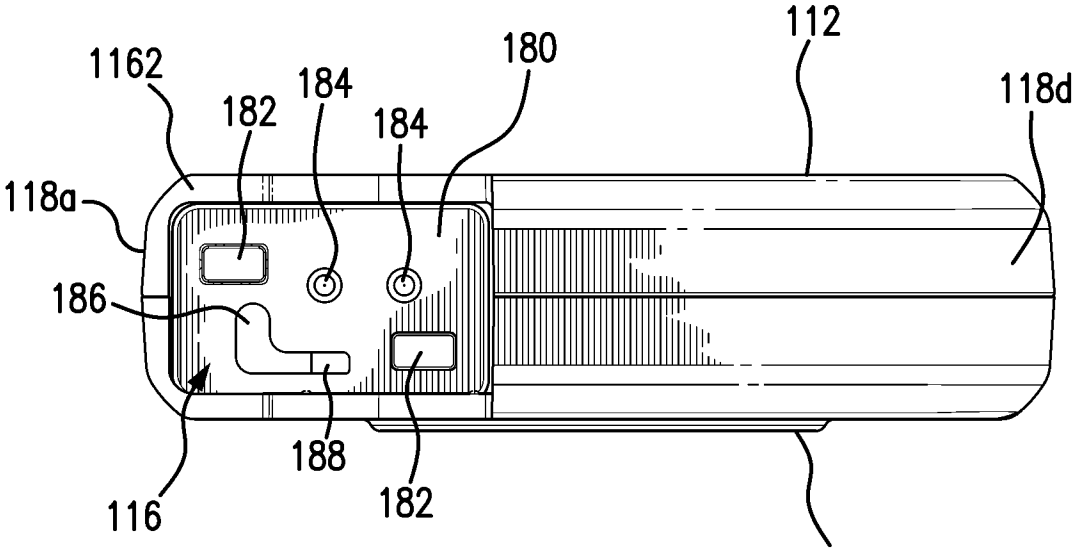
FIG. 12B is a side elevation view of the vaporization device showing the cartridge receiving space thereof.
Figure 12A:
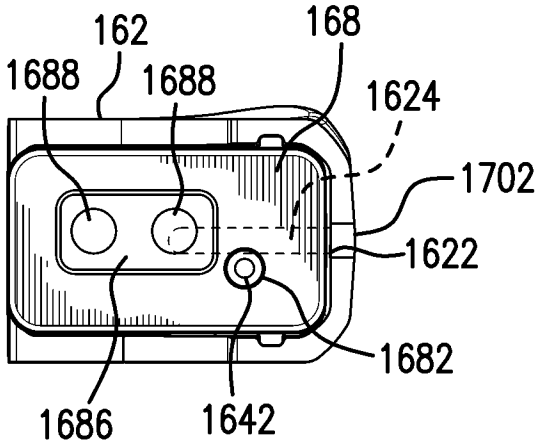
FIG. 12A is a rear elevation view of the vaporizer cartridge of the present invention.
Figure 13:
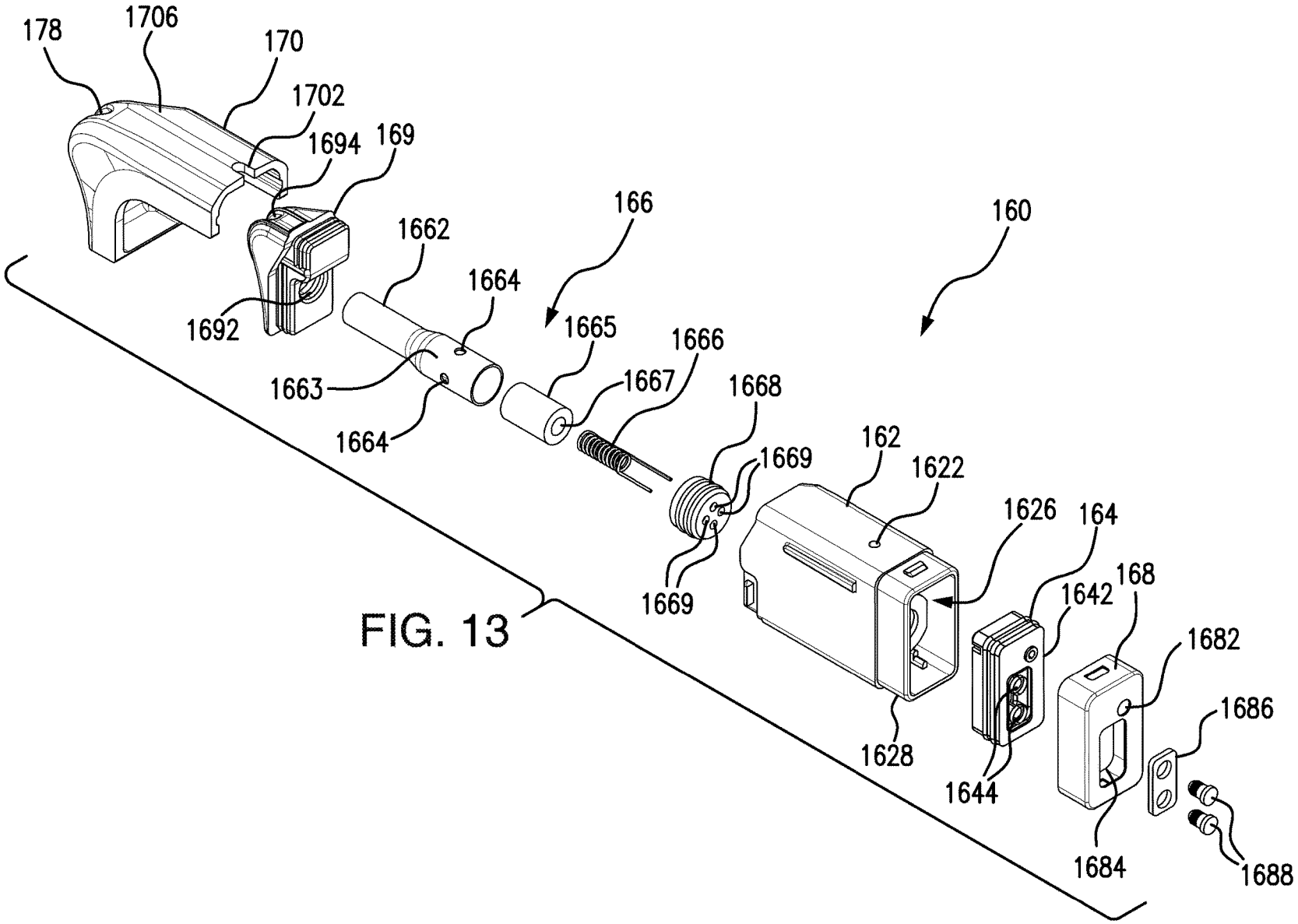
FIG. 13 is an exploded view of the vaporizer cartridge of the present invention.
Figure 14:
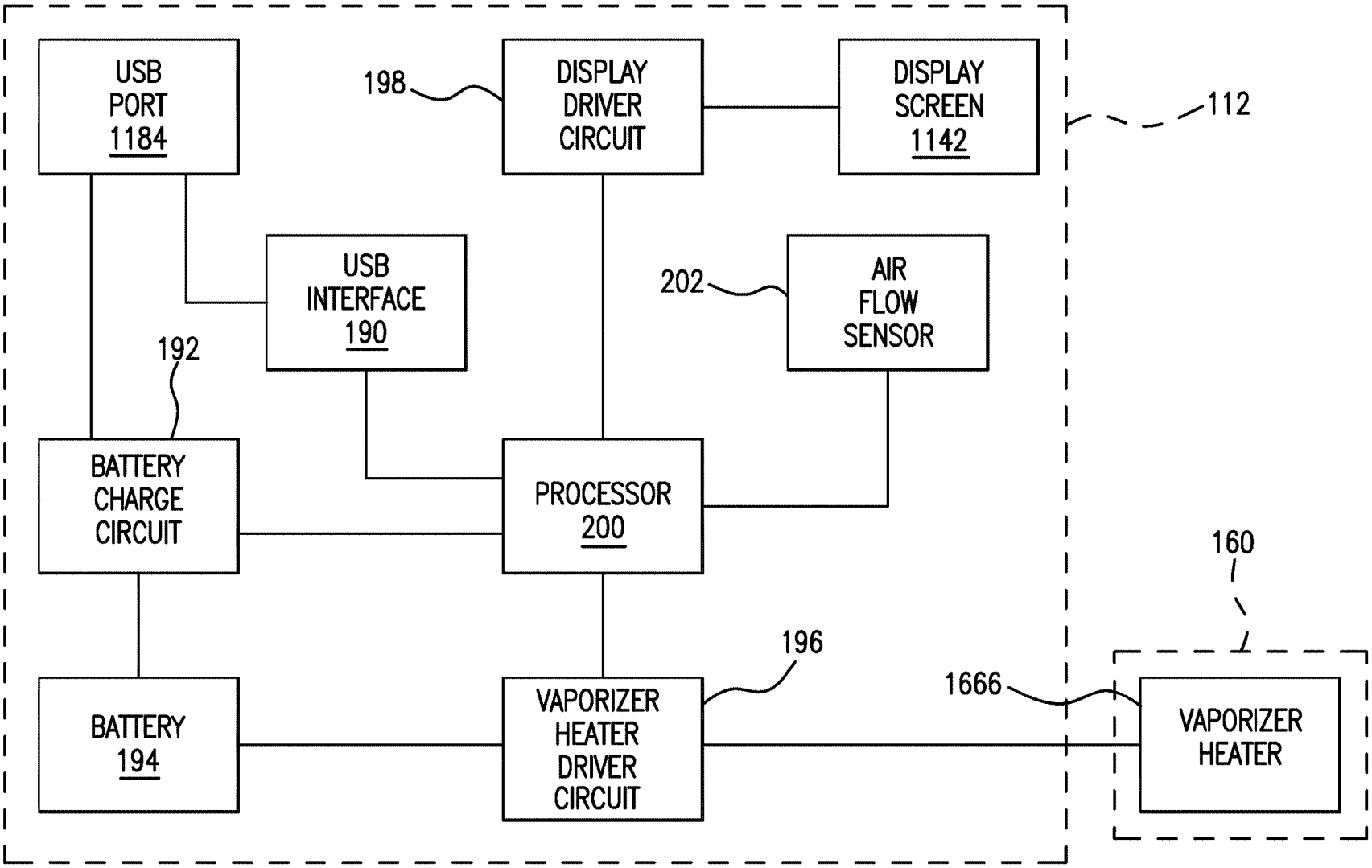
FIG. 14 is a block diagram of the vaporization device and vaporizer cartridge of the present invention.

Turning back to FIGS. 3 and 6, and also referring to FIG. 12B, the vaporization device 110 has a housing 112 having an upper face 114 and a bottom face 120 and a plurality of end walls 118*a*, 118*b*, 118*c* and 118*d* extending between corresponding perimeter edges of the upper and bottom faces 114, 120 on respective sides of the vaporization device housing 112. The upper face 114 has a display screen 1142 providing information to the user, such as time of day, date, battery status, status of the vaporizer cartridge, vaporizable composition fluid level and the like. The display of such information may be triggered by an accelerometer or other sensor detecting movement of the vaporization device, as when the user raises their arm to which the vaporization system 100 is secured, or triggered by operation of a switch function. The switch function may be provided by an electronic switch embodied in the display screen 1142, where the display screen 1142 is a touch screen, or provided by a mechanical switch, such as the switch 1182. Although not important to the inventive concepts disclosed herein, switch 1182 is shown as being disposed in an opening in the end wall 118*b*. The switch function, whether embodied in the mechanical switch 1182 or a touch screen incorporated in display screen 1142, in addition to triggering display of information, may also be used to set the time of day and date functions, as well as selecting to inhibit the display function and/or the sensor triggered display function.

The vaporization device 110 is also provided with a USB port 1184, which as an example is shown as being disposed in an opening in the end wall 118*c*. Here again, the specific location of USB port 1184 is not important to the inventive concepts disclosed herein. USB port 1184 provides an electrical input connection for charging the internal battery of vaporization device 110 and may also provide a data input connection. Referring additionally to the block diagram of FIG. 14, it can be seen that the USB port 1184 provides a connection to the battery charge circuit 192, which is in turn connected to the battery 194 disposed within the vaporization device housing 112. For simplicity of the drawing, the battery connection to all of the identified circuit elements to provide general power thereto is not shown, however it should be understood that the battery provides the necessary power for those circuit elements, as is well known in the art. USB port 1184 is also connected to a USB interface 190 that interfaces signals transferred between the USB port 1184 and the processor 200. By that arrangement, data, such as time of day and date data, software updates, or the like can be input to the processor 200, and status, test and use data or the like can be output from the processor 200 to the USB port 1184.

Processor 200 controls the operation of vaporization device 110 and includes the volatile and nonvolatile memory necessary for its operation. Processor 200 is connected to the battery charge circuit 192 to receive battery voltage and charge circuit status therefrom. Processor 200 is connected to the display driver circuit 198 which is connected to the display screen 1142 to display the battery charger status, battery voltage, which may be displayed as a percentage of charge indication, and time of day and date which are maintained by the processor 200. Processor 200 is connected to an air flow sensor 202 that detects when a user draws air through the vaporizer cartridge 160. Processor 200 is further connected to a vaporizer heater driver circuit 196, disposed in the vaporizer cartridge 160, to enable energization of the vaporizer heater 1666 responsive to the air flow sensor 202 detecting air being drawn through the vaporizer cartridge 160. Vaporizer heater driver circuit 196 is able to detect a quiescent output voltage difference between when the vaporizer heater 1666 is connected to the vaporizer heater driver circuit 196 and when it is not, corresponding to when the vaporizer cartridge 160 is installed and when it is not, and sends that detection status to the processor 200, which information may be displayed to the user.

The two end walls 118*a* and 118*d* on two adjacent sides of the vaporizer device housing 112 do not intersect, as there is an opening 1162 formed therebetween to provide access to the vaporizer cartridge receiving space 116, as shown in FIG. 12B. The receiving space 116 has an end wall 180 separating the receiving space 116 from a remaining internal space of the housing 112 (not shown). The end wall 180 has a pair of electrical contacts 184, 184 for connection to corresponding contacts of the vaporizer cartridge 160 when the vaporizer cartridge body 162 is inserted into the receiving space 116. The end wall 180 further is provided with at least one magnet 182 for releasably holding the vaporizer cartridge 160 in position within the receiving space 116. In the exemplary embodiment shown in FIG. 12B, two magnets 182, 182 are shown for releasably holding the vaporizer cartridge 160 in position. Further, the end wall 180 is formed with an air sensing passage 186 that terminates with an air sensing opening 188 that is connected in fluid communication with the air flow sensor 202. Air flow passage 186 is configured to align with an air passage opening 1682 of the vaporizer cartridge 160, shown in FIG. 12A, when the cartridge body 162 is installed in the receiving space 116.

Referring further to FIGS. 11A, 11B, 11C, 12A and 13, the structure of the vaporizer cartridge is shown. The inventive concepts disclosed herein do not require use of a removable vaporizer cartridge, as the elements that form the vaporizer and storage space for the vaporizable composition may be fixedly incorporated in the vaporization housing 112. However, use of replaceable vaporization cartridges, like the cartridge 160, provides convenience and value to the user.

Vaporizer cartridge 160 includes a cartridge body 162 that forms a housing for the electrically operated vaporizer 166 and a storage space 1626 surrounding the vaporizer 166 for the vaporizable composition, which in the exemplary embodiment described herein, the composition is a liquid containing an active ingredient, such as, but not limited to, nicotine. The electrically operated vaporizer 166 includes an air tube 1662 having one end thereof 1663 that forms a vaporization chamber. Within the vaporization chamber 1663 there is disposed a wick 1665 that may be formed of a non-woven fabric for absorbing the vaporizable liquid composition. The vaporization chamber 1663 has a plurality of liquid inlet openings 1664 through which the vaporizable liquid composition flows to be absorbed by the wick 1665. The wick 1665 is formed with a through bore 1667 into which the heater 1666 is disposed, and when energized vaporizes the liquid composition carried by the material of the wick 1665 to the inner surface of the through bore 1667. The proximal end of the vaporizer 166 is closed by a silicone rubber seal 1668, forming a closure for vaporizer 166 and fitting into an internal wall of the cartridge body 162 (not shown) to seal the lower end of the storage space 1626 that surrounds the vaporizer 166. The seal 1668 has a central portion with a plurality of through openings 1669 through which the terminal ends of the heater pass for connection to electrical contacts 1688 and through which air passes when the user draws air (inhales) through the mouthpiece outlet portion 172.

The upper end of the cartridge body 162 is sealed by an upper seal 169 and includes an opening into which the distal end of the air tube 1662 is tightly received and thereby forms an upper closure of the storage space 1626. The upper seal 169 further includes an outlet air channel 1694 across an outer surface thereof and disposed in correspondence with the outlet opening 178 of the mouthpiece member 170. The mouthpiece member 170 overlays the upper seal 169 and the outlet air channel 1694 provides a flow path from distal end of the air tube 1662 to the outlet opening 178 of the mouthpiece member 170 for the air and vaporized composition mixture generated responsive to a user's inhalation through the vaporization device 110. The mouthpiece member 170 has a front wall 1704, a side wall 1706, an upper wall 176 and a bottom wall 174. When the vaporizer cartridge 160 is installed in the receiving space 116 of the vaporization device housing 112, the front and side walls 1704 and 1706 are respectively contiguous and aligned with the end walls 118*d* and 118*a* of the housing 112. Similarly, the upper wall 176 and a bottom wall 174 of the mouthpiece member 170 are respectively contiguous and coplanar with the upper face 114 and bottom face 120 of the housing 112.

A gasket 164 is fitted into the proximal end 1628 of cartridge body 162 and forms an air seal for the proximal end 1628. Gasket 164 has a pair of openings 1644, 1644 through which the terminal ends of the heater 1666 pass, and an air sensing passage 1642. The proximal end 1628 of cartridge body 162 includes a bottom cover 168 made of ferrous metal so that it will be releasably held within the receiving space 116 of the vaporization device housing 112 by at least one magnet 182 affixed therein, as previously described. Bottom cover 168 is formed with an air passage opening 1682 located in correspondence with the air sensing passage 1642. The bottom cover 168 further is provided with an opening 1684 for receiving the electrical contacts 1688, 1688 therein. The electrical contacts 1688, 1688 are received in corresponding openings in a contact insulator 1686 and electrically connected to the terminal ends of the heater 1666. Contact insulator 1686 is affixed within the opening 1684 of the bottom cover 168. The gasket 164 is formed of a silicone material and may include a portion thereof configured to extend into the opening 1684 and thereby replace the contact insulator 1686. The contacts 1688, 1688 are respectively placed in contact with the electrical contacts 184, 184 of the vaporization device's housing 112 to provide an electrical connection therebetween when the vaporizer cartridge is installed in the receiving space 116 of the housing 112.

The cartridge body 162 has an air inlet opening 1622 through which air is drawn into the vaporizer 166. The mouthpiece member 170 has a side wall 1706 having an air inlet slotted opening 1702 positioned in correspondence with the air inlet opening 1622 of the cartridge body 162. Air inlet opening 1622 connects to an air inlet channel 1624 that in turn connects to the vaporizer 166 and the air sensing passage 1642. Hence, when the user draws air from the mouthpiece outlet opening 178, a low pressure is created in the vaporizer 166 and thereby in the air inlet channel 1624. By its fluid connection to the air inlet channel 1624, a reduced pressure is also created in the air sensing passage 1642 that is transferred to the sensing air passage 186 of the vaporization device housing 112 and thereby to the air sensor opening 188. The air flow sensor 202 detects the reduced pressure and through operation of the processor 200 and vaporizer heater driver 196 energizes the heater 1666 to initiate vaporization of the liquid composition supplied to the heater 1666 by the wick 1665. A mixture of air and the vaporized composition is thereby delivered to the user through the air tube 1662, the outlet air channel 1694 and the mouthpiece outlet opening 178. With the vaporization device 110 installed in the cradle 132 of the vaporizer holder 130, the mouthpiece side wall 1706 is substantially contiguous with an inner surface of a corresponding one of the arm members 1322, as is the air inlet slotted opening 1702. In order to insure an unobstructed air flow path to the air inlet opening of the vaporizer cartridge 160, each of the cradle arm members 1322 has a transversely directed groove 1328 that is positioned to be aligned in correspondence with the air inlet slotted opening 1702 to form an air flow channel through which air may be drawn therethrough and flow through the inlet slotted opening 1702 and air inlet opening 1622. As a groove 1328 is formed in each of the arm members, an air flow channel will be available irrespective of from which direction the vaporization device 110 is inserted into the cradle 132.

Drawing air through the vaporizer cartridge 160 is facilitated by the user's ability to have a good seal between their mouth 12 and the mouthpiece outlet portion 172. The ability to displace the vaporization device 110 relative to the vaporizer holder 130 is one way that a good seal is facilitated. Another is the orientation of the mouthpiece outlet portion 172 which, in one exemplary embodiment of the invention, extends in a horizontally angular direction, at an azimuth angle, with respect to both the mouthpiece side wall 1706 and the mouthpiece front wall 1704. Not only is the mouthpiece outlet portion 172 horizontally angularly directed with respect to the mouthpiece front and side walls 1704 and 1706, but the bottom wall 1724 and/or upper wall 1722 of the mouthpiece outlet portion 172 are upswept with the outlet opening 178 being located between the upper and bottom walls 1722 and 1724. In the exemplary embodiment shown, both of upper and bottom walls 1722 and 1724 are shown to be upswept. The angular orientation of the mouthpiece outlet portion 172 with respect to the mouthpiece front and side walls 1704 and 1706 is an azimuth angle $\phi$, the angle being at 450° 15°. The bottom wall 1724 of the mouthpiece outlet portion 172 is upswept at angle $\theta$ with respect to the bottom wall 174 of the mouthpiece member 170, the angle being 40°±15°, and/or the upper wall 1722 of mouthpiece outlet portion 172 is upswept at an angle $\lambda$ with respect to the upper wall 176 of the mouthpiece member 170, the angle being 7°±3°. The horizontal orientation of the outlet portion 172 permits the user to bring their mouth into contact with the mouthpiece outlet portion 172 without interference by the user's wrist or hand adjacent to the vaporizer holder 130. The upswept bottom and upper walls 1724 and 1722 provide clear access to the mouthpiece outlet portion 172 so that the user's mouth can obtain a good seal therewith.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features. In certain cases, particular locations of elements may be reversed or interposed, all without departing from the spirit or scope of the invention as defined in the appended claims. The scope of the invention should therefore be determined with reference to the description above, the appended claims and drawings, along with their full range of equivalents.

What is being claimed is:

1. A wearable vaporization system, comprising:

a vaporization device having an upper face, a bottom face and a plurality of end walls on respective multiple sides of said vaporization device, each end wall extending between perimeter edges of said upper and bottom faces, said vaporization device further having a mouthpiece from which a vaporized composition mixed with air is withdrawn; and a vaporizer holder configured to be releasably secured to a wrist of a user, said vaporizer holder including a longitudinally extended cradle and a wrist securement strap extending from opposing longitudinal ends of said cradle, said cradle having a longitudinally extended base with a receiving space being defined thereon, said vaporization device being removably retained within said receiving space and from which location a user can withdraw the vaporized composition mixed with air through said mouthpiece;

wherein one of said vaporization device and said vaporizer holder includes at least two detents laterally spaced one from the other, and the other of said vaporizer holder and said vaporization device includes at least two corresponding recesses for releasably retaining said vaporization device in one of a first position and at least one second position, the second position being a laterally extended position to locate said mouthpiece a greater distance from said vaporizer holder than when said vaporization device is in said first position.

2. The wearable vaporization system of claim 1, wherein one of said vaporization device and said vaporizer holder includes at least one detent and the other of said vaporizer holder and said vaporization device includes at least one corresponding recess for releasably retaining said vaporization device against lateral sliding displacement relative to said base.

3. The wearable vaporization system of claim 1, wherein said detents are formed by protruding pins.

4. The wearable vaporization system of claim 1, wherein said detents are formed by elongated protruding ribs.

5. A wearable vaporization system, comprising:

a vaporization device having an upper face, a bottom face and a plurality of end walls on respective multiple sides of said vaporization device, each end wall extending between perimeter edges of said upper and bottom faces, said vaporization device further having a mouthpiece from which a vaporized composition mixed with air is withdrawn; and a vaporizer holder configured to be releasably secured to a wrist of a user, said vaporizer holder including a longitudinally extended cradle and a wrist securement strap extending from opposing longitudinal ends of said cradle, said cradle having a longitudinally extended base with a receiving space being defined thereon, said vaporization device being removably retained within said receiving space and from which location a user can withdraw the vaporized composition mixed with air through said mouthpiece;

wherein one of said vaporization device and said vaporizer holder includes at least two detents laterally spaced one from the other and at least two detents longitudinally space one from the other, and the other of said vaporizer holder and said vaporization device includes at least four corresponding recesses for releasably retaining said vaporization device in one of a first position and at least one second position, irrespective of an orientation of said vaporization device to position of said mouthpiece relative to said vaporizer holder being secured to one of a left or right wrist of a user, the second position being a laterally extended position to locate said mouthpiece a greater distance from said vaporizer holder than when said vaporization device is in said first position.

6. The wearable vaporization system of claim 5, wherein said detents are formed by protruding pins.

7. The wearable vaporization system of claim 5, wherein said detents are formed by elongated protruding ribs.

8. A wearable vaporization system, comprising:

a vaporization device having an upper face, a bottom face and a plurality of end walls on respective multiple sides of said vaporization device, each end wall extending between perimeter edges of said upper and bottom faces, said vaporization device further having a mouthpiece from which a vaporized composition mixed with air is withdrawn; and a vaporizer holder configured to be releasably secured to a wrist of a user, said vaporizer holder including a longitudinally extended cradle and a wrist securement strap extending from opposing longitudinal ends of said cradle, said cradle having a longitudinally extended base with a receiving space being defined thereon, said vaporization device being removably retained within said receiving space and from which location a user can withdraw the vaporized composition mixed with air through said mouthpiece; wherein said vaporizer holder further includes a pair of elastic arm members respectively extending outwardly from opposing longitudinal ends of said base, said receiving space being located between said pair of elastic arm members.

9. The wearable vaporization system of claim 8, wherein each of said arm members have a laterally directed groove formed therein and disposed in a position for one of said arm members to respectively be in correspondence with an air inlet opening of the vaporization device to form an air flow passage irrespective of from which lateral side of said vaporizer holder said vaporization device is inserted into said receiving space.

10. The wearable vaporization system of claim 9, wherein said mouthpiece is formed between an adjacent two of said plurality of end walls, said mouthpiece having an outlet portion being horizontally angled with respect to both of said adjacent two end walls and having upper and lower wall portions with an outlet opening being formed therebetween, at least one of said upper and lower wall portions of said outlet portion of said mouthpiece being angularly upswept.

11. A wearable vaporization system, comprising:

a vaporization device having an upper face, a bottom face and a plurality of end walls on respective multiple sides of said vaporization device, each end wall extending between perimeter edges of said upper and bottom faces, said vaporization device further having a mouthpiece from which a vaporized composition mixed with air is withdrawn; wherein said vaporization device has an opening formed therein and includes a removable cartridge received within said opening and electrically connected thereat, said cartridge including an electrically operated vaporizer and a contained space for storage of a composition to be vaporized by said electrically operated vaporizer; and a vaporizer holder configured to be releasably secured to a wrist of a user, said vaporizer holder including a longitudinally extended cradle and a wrist securement strap extending from opposing longitudinal ends of said cradle, said cradle having a longitudinally extended base with a receiving space being defined thereon, said vaporization device being removably retained within said receiving space and from which location a user can withdraw the vaporized composition mixed with air through said mouthpiece; wherein said vaporizer holder further includes a pair of elastic arm members respectively extending outwardly from opposing longitudinal ends of said base, said receiving space being located between said pair of elastic arm members.

12. The wearable vaporization system of claim 11, wherein said cartridge includes said mouthpiece disposed at one end thereof, said mouthpiece having an outlet portion extending angularly from a corner of said cartridge and having an outlet opening in fluid communication with an outlet of said electrically operated vaporizer.

13. The wearable vaporization system of claim 12, wherein said mouthpiece has two outer wall portions extending from said outlet portion respectively disposed in correspondence with corresponding end walls of said vaporization device and having an air inlet opening formed in one of said mouthpiece wall portions in correspondence with a through opening formed in a wall of said cartridge, said air inlet opening being in open communication with said electrically operated vaporizer for air to flow therein and mix with the vaporized composition responsive to a user performing an inhalation through said outlet opening.

14. The wearable vaporization system of claim 13, wherein each of said arm members has a laterally directed groove formed therein and disposed in a position for one of said arm members to respectively be in correspondence with said air inlet opening of said cartridge to form an air flow passage irrespective of from which lateral side of said vaporizer holder said vaporization device is inserted into said receiving space.

15. The wearable vaporization system of claim 11, wherein said cartridge includes said mouthpiece and said mouthpiece is formed at one end thereof, said mouthpiece having an outlet portion being horizontally angled with respect to two adjacent walls thereof and having upper and lower wall portions with an outlet opening being formed therebetween, at least one of said upper and lower wall portions of said outlet portion of said mouthpiece being angularly upswept.

16. A wearable vaporization system, comprising:

a vaporizer holder configured to be releasably secured to a wrist of a user, said vaporizer holder including a longitudinally extended cradle and a wrist securement strap extending from opposing longitudinal ends of said cradle, said cradle having a longitudinally extended base and a pair of elastic arm members respectively extending outwardly from opposing longitudinal ends of said base to define a first receiving space therebetween;

a housing having an upper face, a bottom face and a second receiving space located between said upper and bottom faces adjacent one side of said housing, said housing having an opening formed between said upper and bottom faces and disposed in open communication with said second receiving space; and a cartridge configured for insertion into said second receiving space through said opening in said housing and releasable coupling with said housing thereat, said cartridge including an electrically operated vaporizer and a contained space for storage of a composition to be vaporized by said electrically operated vaporizer, said cartridge having a mouthpiece disposed at one end of said cartridge, said mouthpiece having an outlet portion extending angularly from a corner of said cartridge and having an outlet opening formed therein through which a vaporized composition mixed with air is withdrawn;

wherein said housing is removably retained within said first receiving space and from which location a user can withdraw the vaporized composition mixed with air through said outlet opening in said mouthpiece.

17. The wearable vaporization system of claim 16, wherein said outlet portion of said mouthpiece has upper and lower wall portions with said outlet opening being formed therebetween, at least one of said upper and lower wall portions of said outlet portion of said mouthpiece being angularly upswept.

18. The wearable vaporization system of claim 16, wherein said cartridge has an air inlet opening formed through a wall thereof, and each of said arm members has a laterally directed groove formed therein and disposed in a position for one of said aim members to respectively be in correspondence with said air inlet opening of said cartridge to form an air flow passage irrespective of from which lateral side of said vaporizer holder said housing is inserted into said receiving space.

19. The wearable vaporization system of claim 16, wherein one of said housing and said vaporizer holder includes at least one detent and the other of said vaporizer holder and said housing includes at least one corresponding recess for releasably retaining said housing against lateral sliding displacement relative to said base.

20. The wearable vaporization system of claim 16, wherein one of said housing and said vaporizer holder includes at least two detents laterally spaced one from the other, and the other of said vaporizer holder and said housing includes at least two corresponding recesses for releasably retaining said housing in one of a first position and at least one second position, the second position being a laterally extended position to locate said mouthpiece a greater distance from said vaporizer holder than when said vaporization device is in said first position.

21. The wearable vaporization system of claim 16, wherein each of said pair of arm members have a longitudinally directed flange formed at a distal end thereof facing the other of said pair of arm members.

* * * * *